US008083158B2

(12) United States Patent
Katzman et al.

(10) Patent No.: US 8,083,158 B2
(45) Date of Patent: Dec. 27, 2011

(54) POP-UP SPRINKLER

(75) Inventors: Zohar Katzman, Haifa (IL); Oded Katzman, Haifa (IL); Micha Ben David, D.N. Galil Alion (IL); Vitaly Gandin, Kiryat Shmona (IL)

(73) Assignee: Naan-Dan Irrigation Systems (C.S.) Ltd., Kibbutz Na'an (IL)

( * ) Notice: Subject to any disclaimer, the term of this patent is extended or adjusted under 35 U.S.C. 154(b) by 998 days.

(21) Appl. No.: 11/589,869

(22) Filed: Oct. 31, 2006

(65) Prior Publication Data

US 2007/0095935 A1 May 3, 2007

Related U.S. Application Data

(63) Continuation-in-part of application No. 10/567,252, filed as application No. PCT/IL2004/000673 on Jul. 22, 2004.

(30) Foreign Application Priority Data

Aug. 5, 2003 (IL) ..... 157246

(51) Int. Cl.

| | |
|---|---|
| ***B05B 15/10*** | (2006.01) |
| ***B05B 3/00*** | (2006.01) |
| ***B05B 3/04*** | (2006.01) |
| ***B05B 1/30*** | (2006.01) |
| ***A62C 37/08*** | (2006.01) |

(52) U.S. Cl. ... 239/204; 239/205; 239/206; 239/222.21; 239/237; 239/570; 169/37

(58) Field of Classification Search ..... 239/1, 201, 239/204, 205, 222.17, 222.21, 200, 203, 239/206, 237, 570; 169/37; 251/48, 50; 137/514.5, 516.27

See application file for complete search history.

(56) References Cited

U.S. PATENT DOCUMENTS

| | | | |
|---|---|---|---|
| 2,585,782 | A | 2/1952 | Johnson |
| 2,901,183 | A | 8/1959 | Kohl |
| 3,131,867 | A | 5/1964 | Miller et al. |
| 3,282,508 | A | 11/1966 | Roberts |
| 3,709,435 | A | 1/1973 | Sheets |
| 3,727,842 | A | 4/1973 | Ertsgaard et al. |
| 3,921,911 | A | 11/1975 | Sheets |

(Continued)

FOREIGN PATENT DOCUMENTS

| | | |
|---|---|---|
| WO | 2005/011359 A1 | 2/2005 |

(Continued)

*Primary Examiner* — Len Tran
*Assistant Examiner* — Steven M Cernoch
(74) *Attorney, Agent, or Firm* — The Nath Law Group; Susanna M. Hopkins; William L. Klima

(57) ABSTRACT

A sprinkler comprising a housing fitted with an inlet port connectable to a water supply line and extending into an inlet chamber, a hollow stem member with an inlet end thereof being in flow communication with said inlet chamber and an outlet end thereof being in flow communication with an irrigation head, a diaphragm seal sealingly fixed at peripheral boundaries thereof to the housing and sealingly articulated to the stem member and supporting it at an essentially upright position. The diaphragm is deformable between a first position in which the irrigation head is retracted within the housing and a second position in which the irrigation head projects from the housing. The sprinkler comprising at least one guard portion adapted to prevent insects and undesirable material from entering the sprinkler housing during said second position.

46 Claims, 19 Drawing Sheets

U.S. PATENT DOCUMENTS

| | | | | | |
|---|---|---|---|---|---|
| 3,955,764 | A | | 5/1976 | Phaup | |
| 4,113,181 | A | | 9/1978 | Sheets | |
| 4,145,003 | A | * | 3/1979 | Harrison et al. | 239/288 |
| 4,429,832 | A | | 2/1984 | Sheets | |
| 4,637,548 | A | * | 1/1987 | Ray et al. | 239/201 |
| 4,754,925 | A | | 7/1988 | Rubinstein | |
| 4,763,838 | A | | 8/1988 | Holcomb | |
| 4,796,804 | A | | 1/1989 | Weiss | |
| 4,796,810 | A | * | 1/1989 | Zakai | 239/222.17 |
| 4,834,290 | A | * | 5/1989 | Bailey | 239/205 |
| 4,919,332 | A | * | 4/1990 | Bailey | 239/205 |
| 6,000,634 | A | * | 12/1999 | Mehoudar | 239/222.17 |
| 6,016,972 | A | | 1/2000 | Kantor et al. | |
| 6,186,413 | B1 | * | 2/2001 | Lawson | 239/205 |
| 6,340,059 | B1 | * | 1/2002 | Bethea | 169/37 |
| 6,439,476 | B1 | * | 8/2002 | Boggs | 239/203 |
| 6,457,656 | B1 | * | 10/2002 | Scott | 239/205 |
| 2002/0153432 | A1 | * | 10/2002 | McKenzie et al. | 239/237 |
| 2007/0095935 | A1 | | 5/2007 | Katzman et al. | |

FOREIGN PATENT DOCUMENTS

| | | | | |
|---|---|---|---|---|
| WO | WO 2005011359 | A1 | * | 2/2005 |

* cited by examiner

POP-UP SPRINKLER

This application is a Continuation-In-Part, and claims the benefit of, U.S. application Ser. No. 10/567,252, filed on Jul. 22, 2004.

FIELD OF THE INVENTION

This invention relates to sprinklers and more specifically to so-called pop-up or riser sprinklers where the irrigation head assembly is spontaneously displaceable responsive to water pressure, between a retracted position, namely a non-active position, and an extracted position, namely an active position.

BACKGROUND OF THE INVENTION

A wide variety of pop-up sprinklers are known where a housing is typically buried under. ground surface where the sprinkler is concealed for both aesthetic reasons and for practical ones, e.g. to facilitate easy lawn mooring, to prevent the sprinkler from being an obstacle to pedestrians, etc. In some cases a pop-up sprinkler is intended for increasing the irrigation range, or for over coming obstacles such as a bush, a decorative stone, a fence, etc. These objects are however achieved by a substantially large housing with a corresponding long pop-up stem member, requiring suitable sealing means.

A different type of pop-up sprinklers is of the kind comprising a membrane deformable between a retracted position and an elevated position, responsive to water supply pressure. Such sprinklers are described, for example, in U.S. Pat. No. 3,282,508 to Bailey and U.S. Pat. No. 4,919,332 to Roberts.

It is an object of the present invention to provide a pop-up sprinkler fitted with an improved raising mechanism which, on the one hand, is inexpensive and easy to assemble and, on the other hand, offers many advantages such as compact structure, smooth and trouble-free operation, insect and dirt protection, inverted installation ('top down'), etc. Furthermore, the sprinkler according to the present invention offers much diversity for various purposes. For example, the sprinkler may be integrally fitted with a flow control assembly and a leak-preventing device, with an in-line filter, etc.

SUMMARY OF THE INVENTION

According to the present invention there is provided a sprinkler comprising a housing fitted with an inlet port connectable to a water supply line and extending into an inlet chamber, a hollow stem member having an inlet end thereof being in flow communication with said inlet chamber and an outlet end thereof being in flow communication with an irrigation head; a diaphragm seal sealingly fixed at peripheral boundaries thereof to the housing and sealingly articulated to the stem member and supporting it at an essentially upright position; said diaphragm being deformable between a first position in which the irrigation head is retracted within the housing and a second position in which the irrigation head projects from the housing.

The sprinkler displaces into its open, extended position by hydraulic forces, i.e. hydrostatic force rather than reactionary forces of water impinging against a surface of the irrigation head.

According to some embodiments of the invention, the diaphragm seal is beveled, however according to other embodiments the diaphragm seal may have other shapes. e.g. a flat disk, a conical disc, a gradually beveled disc, etc. However, where the diaphragm seal has a non-flat section (e.g. beveled/conical section—collectively referred to hereinafter as a beveled diaphragm seal), it offers some advantages.

A beveled diaphragm seal toggles into its respective first and second positions and according to a particular feature of the sprinkler of the present invention, the beveled diaphragm seal is substantially un-tensed at either of its two respective beveled positions. According to one specific arrangement, at its second beveled position the beveled diaphragm seal bears against a supporting surface where the beveled diaphragm seal bears against the inclined surface and under water pressure provides hydraulic seal.

When the diaphragm seal is beveled, it may be used to generate an axial force giving rise to a biasing effect e.g. for sealing a leek preventing device (LPD) fittable at an inlet of the sprinkler, whereby a spring may be used or eliminated.

According to modifications of the invention, rather then a beveled diaphragm there may be provided a rolling type membrane or a peel away type diaphragm.

Furthermore, axial displacement of the stem member is restricted, thereby restricting stress of the beveled diaphragm seal. Axial displacement restriction is obtained, for example, by a projecting shoulder of the stem member engageable with a corresponding bearing surface of the housing.

Furthermore, the housing is formed with a radial support to facilitate only axial (sliding) displacement of the stem member, thereby preventing rotary displacement and reducing generation of forces to the diaphragm seal.

According to the present invention, the sprinkler further comprises a bridge member articulated to one of the stem member and the irrigation head, whereby a shielding portion of the housing is closable by said bridge member at the first position. By one embodiment, the shielding portion is formed with one or more drain ports and still, the one or more drain ports are sealable at the first position. The arrangement according to one embodiment is such that at the second position a portion of the stem or of an articulated bridge portion displaces into sealing engagement with the one or more drain ports.

The sprinkler according to the present invention is formed, according to one of its embodiments, with a radial support to facilitate only axial displacement of the stem member. Such a radial support may be in the form of an annular neck portion or support ribs or segments, integrally formed with the housing or fixed thereto, slidingly supporting the stem member.

According to another embodiment of the present invention the inlet chamber is fitted with a flow control assembly comprising a flexible membrane retained within the inlet chamber which responsive to pressure differential thereover is deformable to constrict the cross section area of a liquid flow path into the inlet end of the stem member.

The arrangement according to a particular application is such that at the first beveled position the flexible membrane bears against the inlet port, thus serving as a leak preventing device, ensuring the inlet port is sealed until water pressure at the inlet port reaches a minimal nominal pressure.

The sprinkler according to the present invention also offers a positively sealed sprinkler, at all positions thereof, a sealing of draining ports at the closed, retracted position of the sprinkler and drainage of said draining ports at the open, extracted position of the sprinkler.

Additionally, a sprinkler of the present invention may comprise one or more guard portions to prevent insects and undesirable material from entering the sprinkler housing during operation thereof. The guard portion(s) may be associated with the bridge member, irrigation head, stem member, etc, and may be integrally formed therewith. The guard portion(s) may be of annular shape, or any shape suitable for the above stated purpose.

BRIEF DESCRIPTION OF THE DRAWINGS

In order to understand the invention and to see how it may be carried out in practice, some embodiments will now be described, by way of non-limiting examples only, with reference to the accompanying drawings, in which:

FIGS. 1A-1D are directed to a first embodiment of a sprinkler in accordance with the present invention wherein:

FIG. 1A is an exploded isometric view;

FIG. 1B is a sectional elevation of the sprinkler in the so-called closed position; and FIG. 1C is a sectional elevation of the sprinkler in the so-called open position;

FIG. 1D is an isometric view from below of a stem member integrated with a filter;

FIGS. 5A-5C are directed to a sprinkler in accordance with a second embodiment of a sprinkler in accordance with the present invention, wherein:

FIG. 5A is an isometric exploded view of the sprinkler;

FIG. 5B is a longitudinal sectional view of the sprinkler in its closed position; and FIG. 5C is a longitudinal section of the sprinkler in its open, pop-up position;

FIGS. 6A-6C illustrate a sprinkler in accordance with still another embodiment of the present invention wherein:

FIG. 6A is a perspective exploded view of the sprinkler;

FIG. 6B is a longitudinal section of the sprinkler in the closed position; and FIG. 6C is a longitudinal section of the sprinkler in the pop-up position;

FIGS. 7A and 7B illustrate a sprinkler according to a modification of the invention, wherein:

FIG. 7A is a longitudinal section of the sprinkler at its closed/retracted position; and FIG. 7B is a longitudinal section of the sprinkler at its open/operative position, rotated about 90° with respect to the presentation of FIG. 7A;

FIGS. 8A and 8B illustrate a sprinkler according to still another modification, wherein:

FIG. 8A is a longitudinal section of the sprinkler at its closed/retracted position; and FIG. 8B is a longitudinal section of the sprinkler at its open/operative position;

FIGS. 9A-9F illustrate a sprinkler in accordance with a further embodiment of the present invention, wherein:

FIG. 9A is an isometric view of an alternative bridge member with a guard portion;

FIG. 9B is an isometric view of an alternative irrigation head with a guard portion;

FIG. 9C is a perspective view of the sprinkler in closed/retracted position;

FIG. 9D is a perspective view of the sprinkler in open/operative position;

FIG. 9E is a longitudinal section of the sprinkler in closed/retracted position; and FIG. 9F is a longitudinal section of the sprinkler in closed/retracted position.

DETAILED DESCRIPTION OF THE INVENTION

Figure 1A:
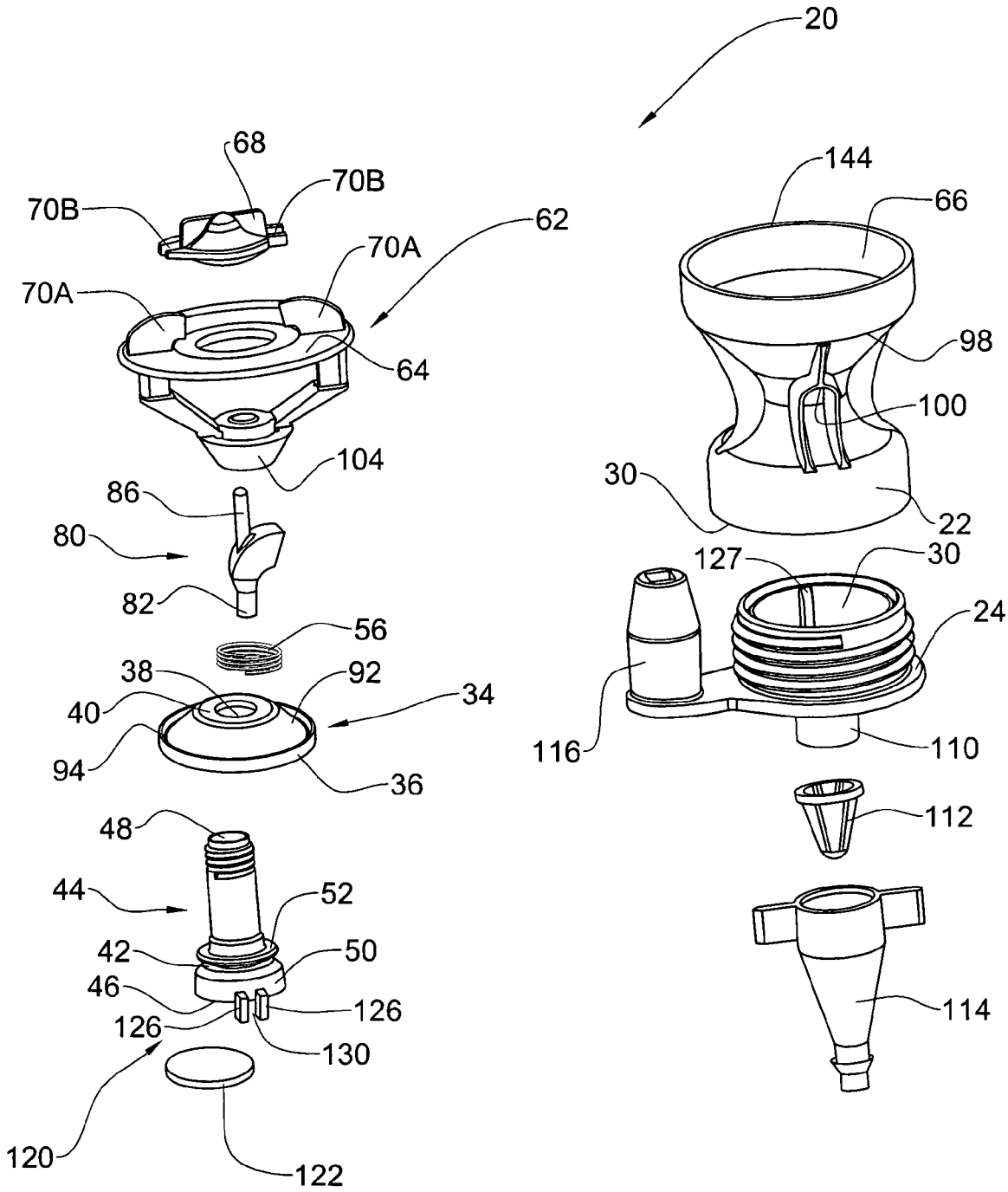
Figure 1B:
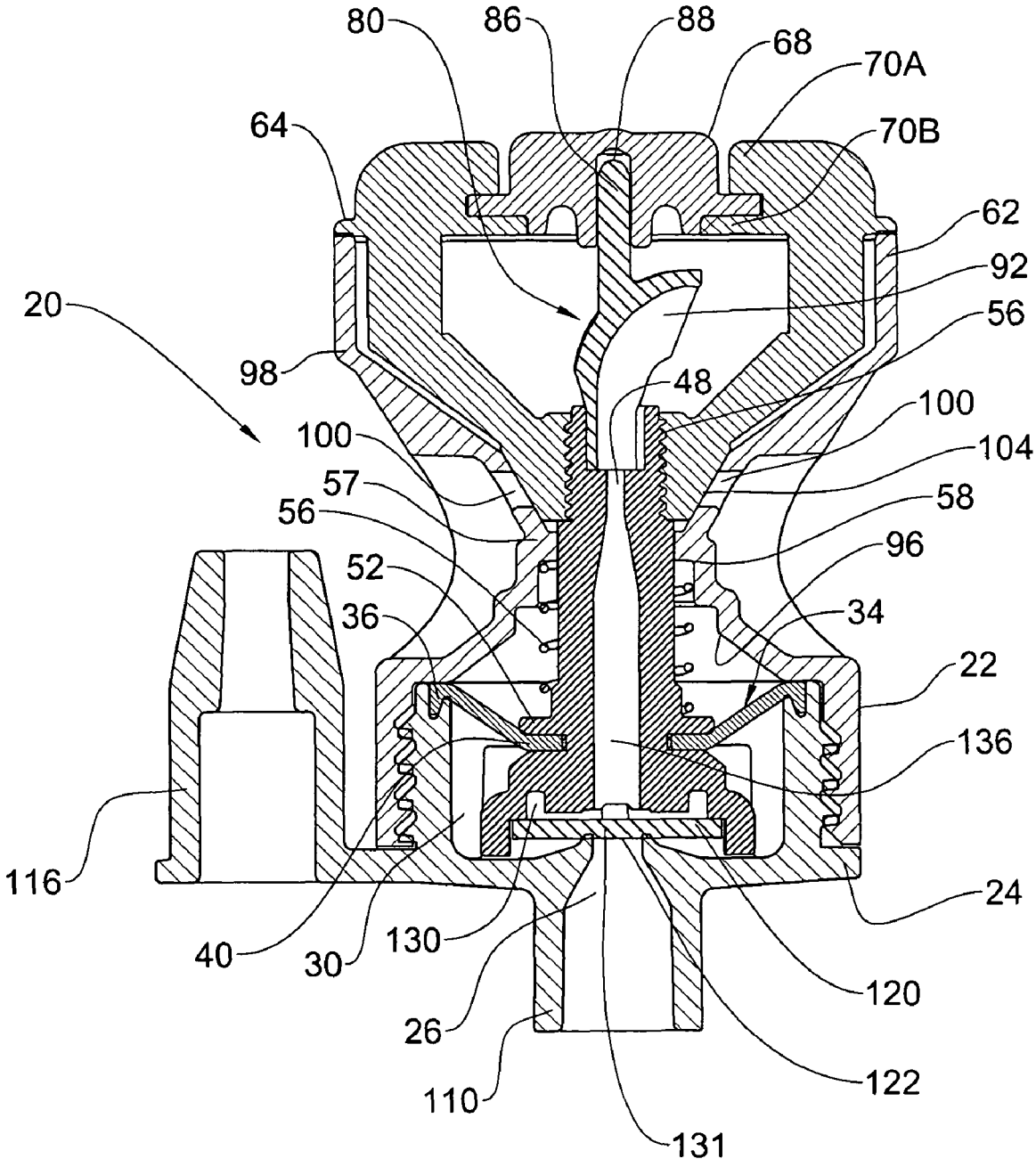
Figure 1C:
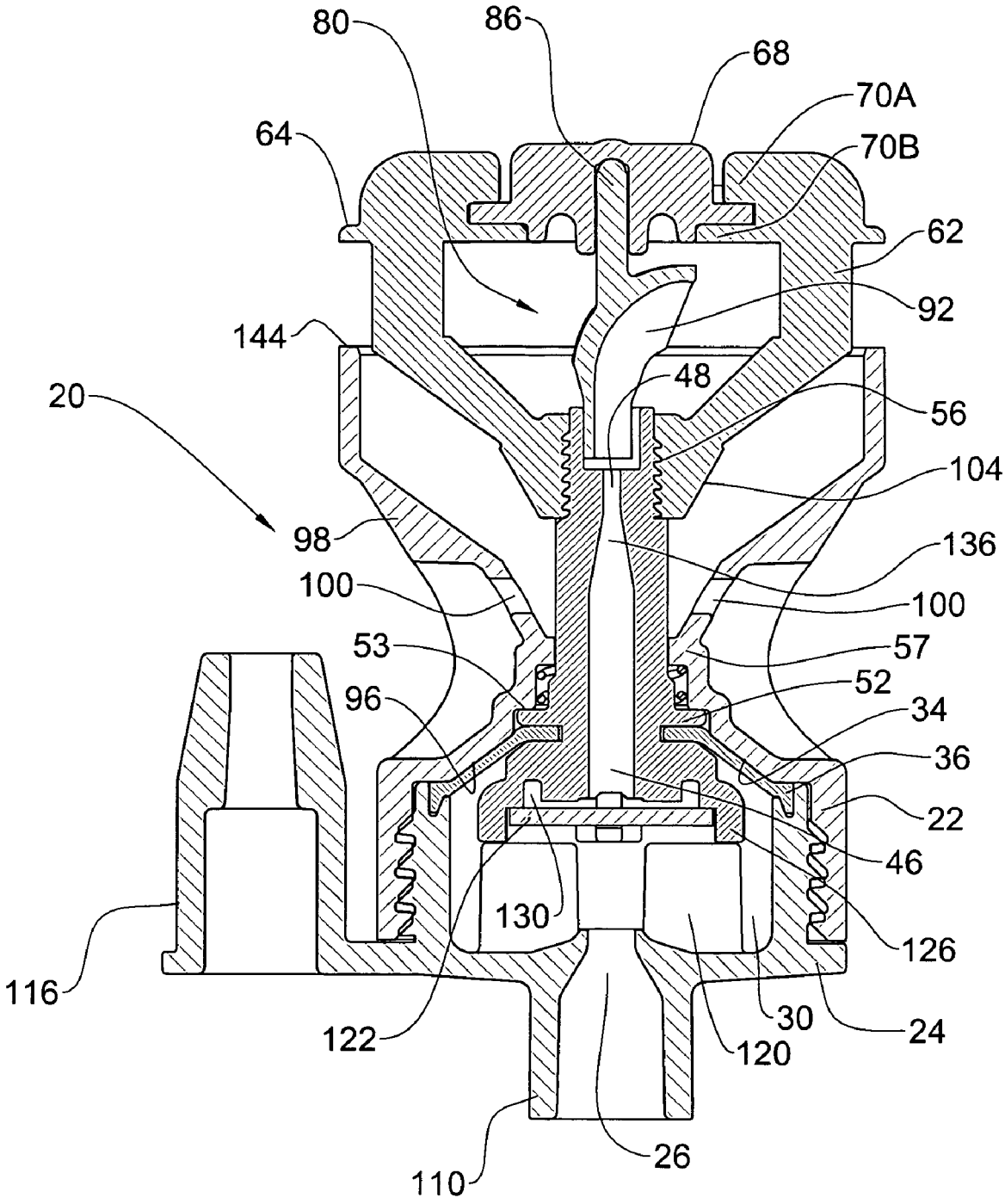

Attention is first directed to FIGS. 1A to 1C illustrating a pop-up sprinkler in accordance with the present embodiment generally designated 20. The sprinkler comprises a housing 22 fitted with a bottom cap 24 for screw engagement therewith, the latter comprising an inlet port 26 extending into an inlet chamber 30. In assembly of the sprinkler 20, the cap 24 screw clamps a beveled diaphragm seal 34 at a peripheral boundary rim 36, thus retaining the beveled diaphragm seal 34 in place within the housing.

The beveled diaphragm seal 34 is formed with a central aperture 38 wherein the inner peripheral boundaries 40 thereof are annularly arrested within an annular groove 42 of a hollow stem member generally designated 44, supporting the latter in an essentially upright position such that an inlet end thereof 46 extends below the beveled diaphragm seal 34 and an outlet end thereof 48 extends above the beveled diaphragm seal 34, as can be seen in FIGS. 1B and 1C.

The annular groove 42 is formed between a first annular shoulder 50 and a second annular shoulder 52. A coiled spring 56 is provided having one end thereof bearing against annular support 52 with an opposed end thereof bearing against an opposite annular portion 58 of the housing 22, thus biasing the beveled diaphragm seal 34 and the associated stem 44 into a downward, retracted position as in FIG. 1B.

A bridge member 62 is screw coupled or otherwise articulated to the stem member 44 (e.g. by snap fitting etc.), said bridge 62 having a top cover portion 64 sized and shaped to close a top opening 66 of housing 22. The bridge member 62 is fitted with a locking piece 68 engagable by means of arresting ribs 70A and 70B projecting from the bridge member 62 and the locking piece 68, respectively. A reactionary rotatable irrigation head 80 comprises an inlet portion 82, which is rotatably received within a receptacle provided at the outlet end 48 of the stem member 44. The head 80 is formed with an axially projecting boss 86 rotatably supported within an opening 88 formed in the locking piece 68, the arrangement being such that the irrigation head 80 is rotatably supported with little friction whereby it freely rotates owing to reactionary forces developing upon water flow about a reactionary surface 93 (FIGS. 1B and 1C).

The beveled diaphragm seal 34 (FIG. 1A) is normally at either of its beveled positions, i.e., a first position as in FIG. 1B when the irrigation head 80 is retracted and does not project from the housing 22, and a second position, as in FIG. 1C wherein the irrigation head projects from the housing in its operable position. The beveled diaphragm seal 34 is un-tensed at either of its two respective beveled positions. The diaphragm seal 34 comprises a normally beveled portion designated 92, with an annular resilient portion 94 extending between the peripheral portion 36 and the beveled portion 92, where deformation of the beveled diaphragm seal 34 occurs mainly about said annular resilient portion 94 in a toggle-fashion.

Furthermore, as seen in FIGS. 1B and 1C, the housing 22 is formed with a diaphragm seal support portion 96 having a shape corresponding with that of the beveled diaphragm seal 34 in its second position such that at said second position the diaphragm seal 34 bears against said surface 96 to ensure the diaphragm beveled seal 34 is not tensioned, as in FIG. 1C. This arrangement ensures that substantially no tension is applied to the beveled diaphragm seal and accordingly, a relatively thin and inexpensive such seal may be used. Bearing of the beveled diaphragm seal against the corresponding inclined surface 96 of the housing 22 also provides for hydraulic seal, increasing seal contact.

It is further noted that at the second position, the axial displacement of the stem member 44 is restricted by the annular projecting shoulder 52 encountering a corresponding shoulder 53 of the housing 22 to thereby prevent tensioning or stressing of the beveled diaphragm seal 34.

Although not illustrated in the drawings, it is appreciated that the suitable rotary dampeners may be used, e.g. a viscose dampener (of the type comprising a viscous substance such as silicone), etc. For example, such a dampener may be incorporated in the locking piece 68.

With particular reference to FIGS. 1B and 1C, the housing 22 is formed with an annular support neck portion 57 for slidingly supporting the stem member 44, allowing it to displace only in an axial direction without any tilt or rotation. Rather then the annular portion 57, there may be formed several ribs or segments (not shown) supporting the stem member.

As can further be seen in the figures, the housing 22 is formed with a shielding portion 98 which accommodates the irrigation head and which at the retracted position (FIG. 1B) is closed by means of bridge member 62. The shielding portion 98 is formed with two drain ports 100 (only one of which is seen in FIG. 1A). The arrangement is such that at the second position, namely the operative position of the sprinkler, the drain ports 100 are opened to ensure proper drain of the housing. However, when the sprinkler is in its retracted position, as in FIG. 1B, the drain ports 100 seal by means of a corresponding sealing portion 104 coming to rest against the drain ports 100. In this position the housing is sealed and protects the assembly from dirt and insects.

As can further be seen, the cap 24 is fitted with an extension piece 110 accommodating an integral filter 112 retained in place by a connecting piece 114 suited for pressure fit to a water supply tube (not shown). The cap member 24 is further formed with a support 116 for mounting on a post (not shown) at any desired position either suspending from above at an inverted position (the bridge member 62 facing downwards) or at an upright position as in the figures.

Sprinkler 20 further comprises a flow control assembly generally designated at 120 comprising a flexible disc-like membrane 122 retained within the inlet chamber 30 by retention leg members 126 with an inlet passage 130 formed between the legs 126 to ensure flow communication about both faces of the membrane 122. Legs 126 further prevent rotary displacement between the stem member 44 and the cap 24.

Figure 1D:
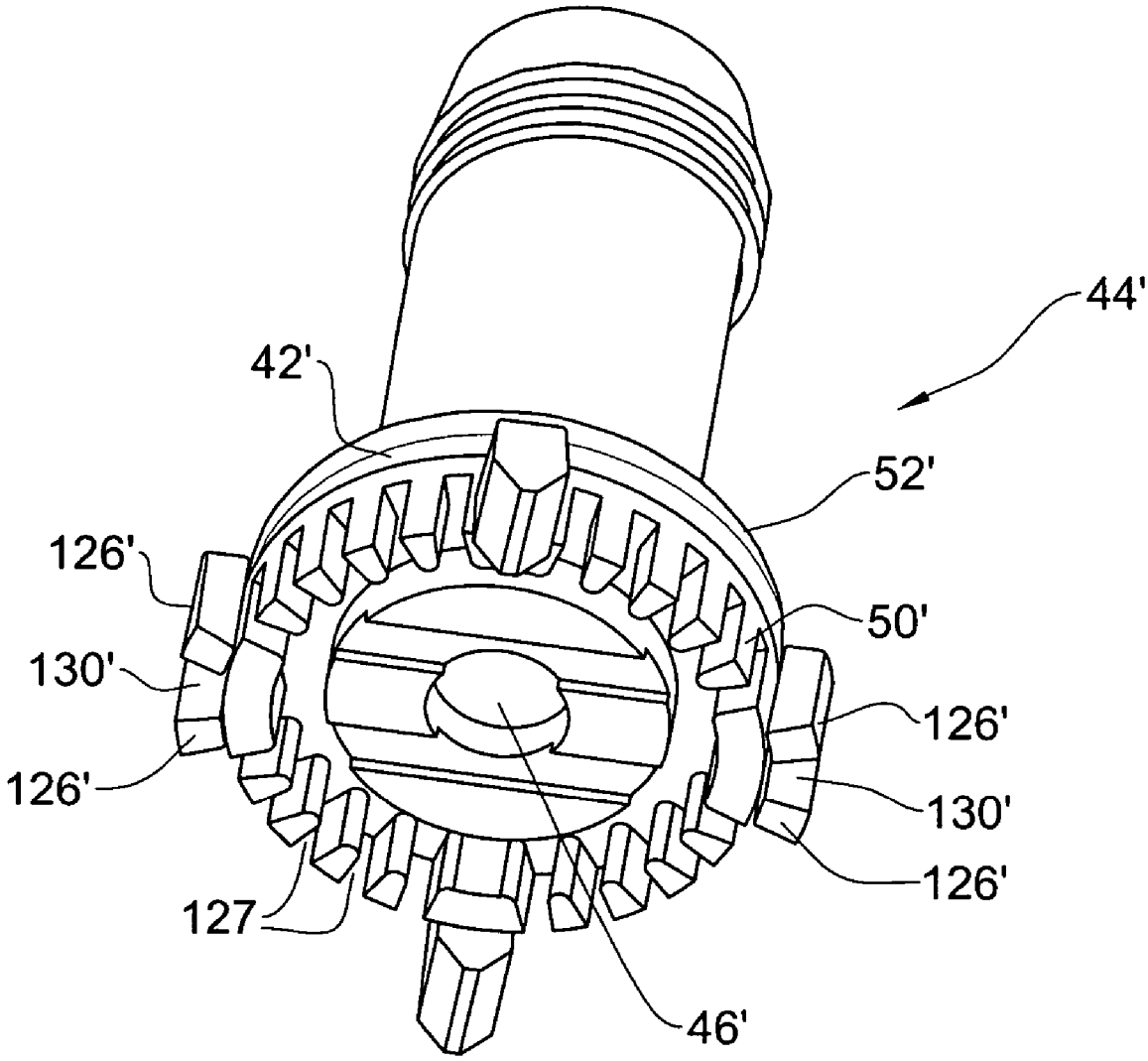

A particular application of the invention is illustrated in FIG. 1D, wherein like elements as in FIGS. 1A to 1C are designated like reference numbers with a prime (')indication. The stem member generally designated 44' is similar to that seen in FIGS. 1A to 1C, and comprises an inlet port 46', an annular groove 42' formed between a first annular shoulder 50' and a second annular shoulder 52, retention leg members 126' with an inlet passage 130' formed therebetween, wherein said second annular shoulder 52' is formed with a plurality of openings 127 opening into the flow control assembly 120 thus forming an integral filter unit. It is noted that the openings 127 are wider at their inner end, to prevent dirt from clamping therein.

In use, the sprinkler is normally at its closed position as in FIG. 1B, wherein the beveled diaphragm seal 34 is at its first beveled position and the irrigation head 80 is retracted and does not project from the housing 22, owing to the biasing effect of coiled spring 56. However, upon introducing water pressure through inlet port 26, pressure develops within the inlet chamber 30 resulting in toggle deformation of the beveled diaphragm seal 34 into its second position (as in FIG. 1C) entailing corresponding displacement of the stem member 44 along with the associated irrigation head, whereby water flows through a lumen 136 of the stem member 44 flowing out through the outlet end 48 into the irrigation head 80 and causing it to rotate under influence of reactionary forces developing about reactionary surface 93 so as to radially admit water in the gap 140 formed between the cover portion 64 of bridge member 62 and a top edge 144 of the housing 22.

Upon ceasing the water supply through inlet port 26 the pressure within the inlet chamber 30 decreases and under influence of the coiled spring 56 the beveled diaphragm seal 34 toggles back into its first position (FIG. 1B) with the bridge member 62 closing the housing 22 and the drain ports 100 being sealed with corresponding sealing portion 104 as discussed hereinabove.

The flow control assembly 120 acts as a differential pressure assembly wherein the membrane 122 deforms responsive to pressure differential between its inlet face and its outlet face to thereby vary the through flow into the inlet end 46 of the stem member 44, thereby restricting water flow therethrough.

The sprinkler disclosed hereinabove is of simple construction and is easy to assemble and disassemble for maintenance. Furthermore, an outlet nozzle of different nominal outlet flow may be fitted at an outlet end 48 of the stem member 44. For example, each nozzle may be of a different color corresponding with its nominal through-flow. The replaceable nozzles may have a nominal outlet flow of say between 25 to 200 liters/hour.

It is further appreciated that the beveled diaphragm seal 34 divides the housing into a pressurized zone at a side thereof facing the inlet port, and an essentially atmospheric pressure zone at its other side.

Figure 2A:
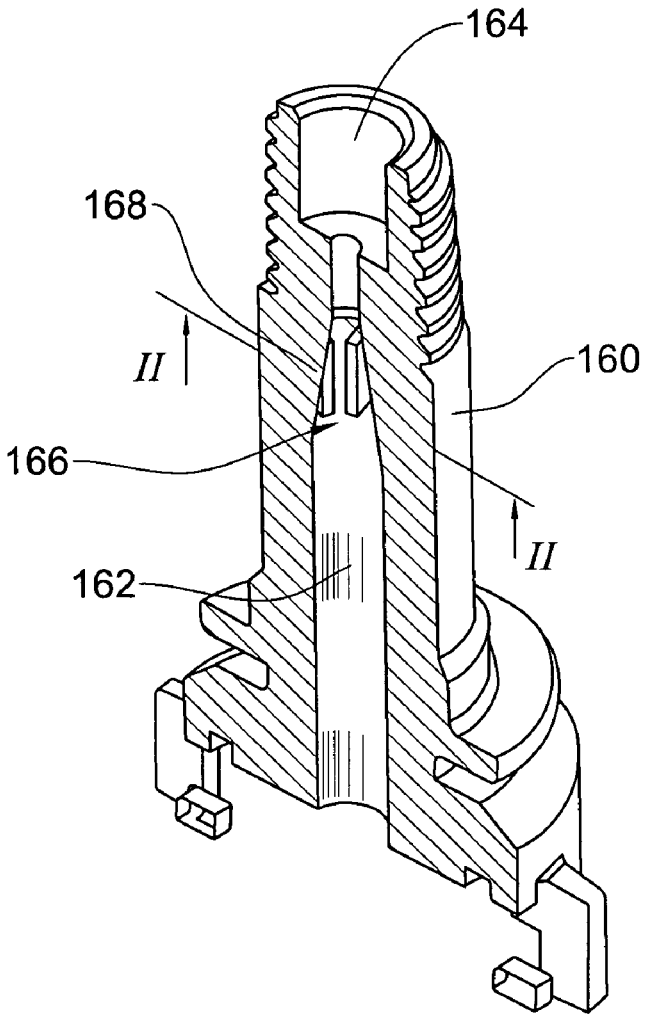
FIG. 2A is a longitudinal isometric section of the stem member used in a sprinkler in accordance with the present invention.
Figure 2B:
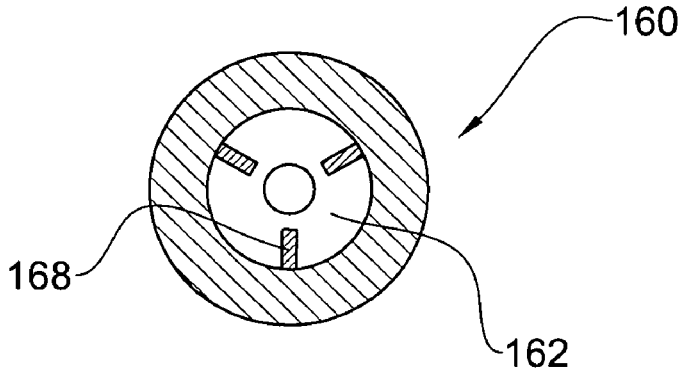
FIG. 2B is a section along line II-II in FIG. 2A.

In FIGS. 2A and 2B there is illustrated an alternative embodiment of a stem member in accordance with the present invention generally designated 160 being substantially similar to the stem member 44 referred to in FIGS. 1A-1C with the exception that its lumen 162 is formed adjacent the outlet end 164 with a flow straightening arrangement 166 in the form of fins 168 (referred to in the art also as straightening vanes) extending radially inwards for imparting the water flowing through the lumen 162 a regular smooth flow towards its outlet through the outlet end 164. The zone in the lumen 162 extending below the fins 168 is referred to as the 'quiet zone'.

It is also noted in FIG. 2A that the outlet end 164 of the stem member 160 is formed with a receptacle suited for receiving the irrigation head (not seen) or a flow restricting nozzle (orifice), as discussed hereinbefore.

Diaphragm 122 of the flow control assembly 120 serves also as a leak preventing device (LPD) i.e. before build up of a minimal pressure, the diaphragm 122 bears against the nozzle end 131 of inlet port 26 (see FIG. 1B) in a sealing manner. The LPD also prevents suction of dirt, sand, etc into the water supply line.

The drain ports 100 are formed at a lower portion of the cone-like shielding portion 98, ensuring drainage of water therefrom.

Figure 3A:
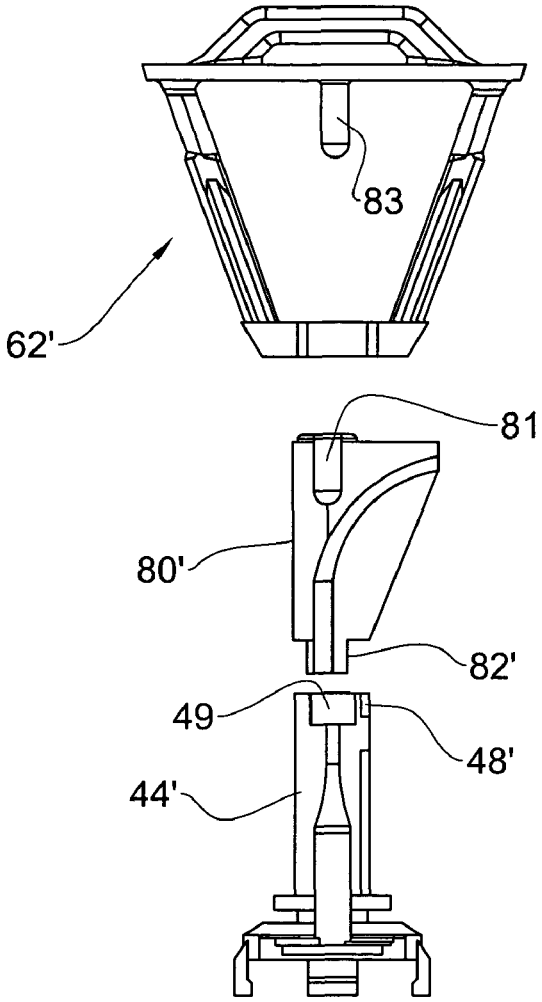
FIGS. 3A and 3B are sectioned side views of a stem, bridge member and irrigation head according to a modification of the invention, at an exploded view and an assembled view, respectively.
Figure 3B:
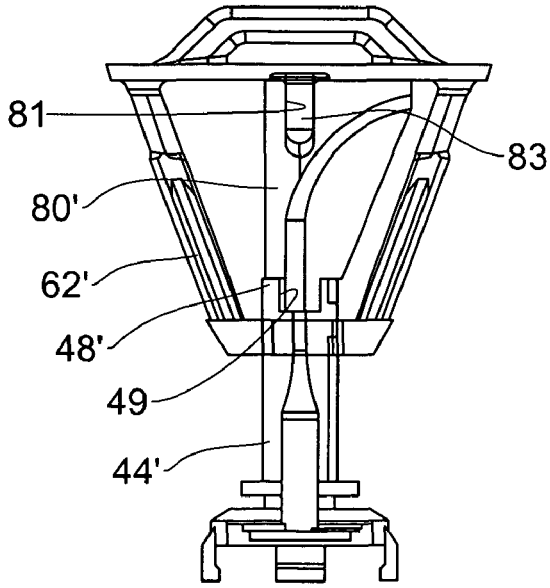

Turning now to FIGS. 3A and 3B there is illustrated only a portion of a sprinkler according to a modification of the embodiment of FIGS. 1A to 1C and accordingly like elements are given like reference numbers with a prime (') indication. According to this modification, the stem member 44' is fitted at its outlet end 48' with a receptacle 49 rotatably receiving the irrigation head 80', the later comprising an inlet portion 82' rotatably receivable within receptacle 49, and at its opposite end there is formed a bore 81 rotatably receiving a corresponding boss 83, projecting from bridge member 62' or inversely, as disclosed in connection with FIGS. 4A to 4C.

Other arrangements are possible to, such as, for example, applying a rotation dampener (not shown) such as a silicone dampener fitted at either the bridge member or the irrigation head, as known per se.

Figure 4C:
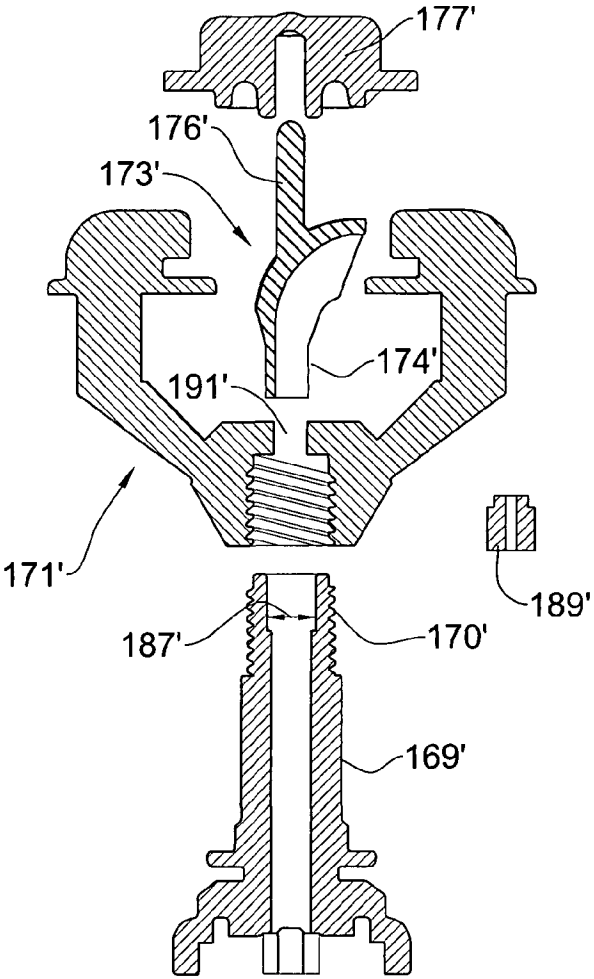
FIGS. 4A to 4C are sectioned exploded side views illustrating three alternatives of applying an outlet nozzle in accordance with modifications of the embodiment of FIG. 1.

In accordance with some other embodiments of the invention an outlet nozzle of the sprinkler may be fitted at different locations and at different combinations. A first example is illustrated in FIG. 4A, corresponding with the embodiment of FIGS. 1A to 1C, where same elements are given same reference numbers. According to this embodiment the outlet nozzle 167 is formed integral with the stem member, by means of a narrowing portion thereof.

Figure 4B:
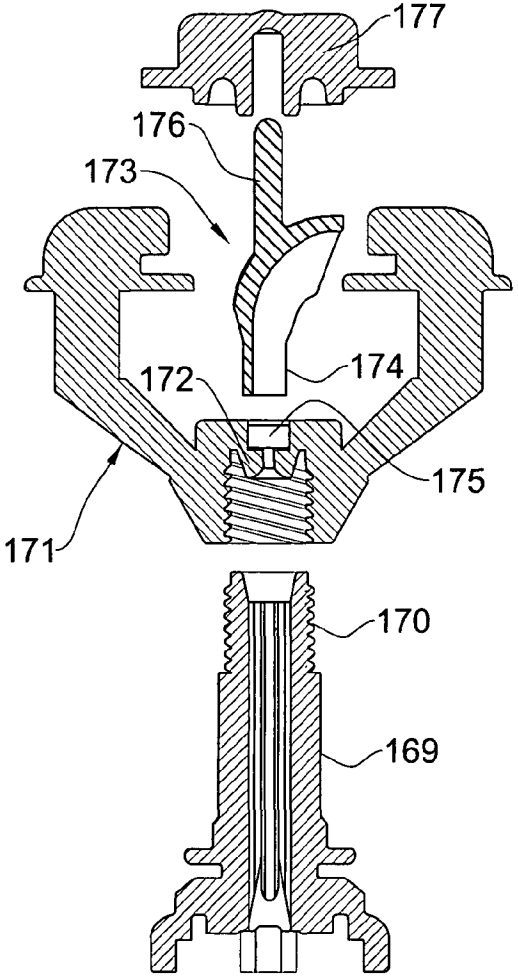
Figure 4A:
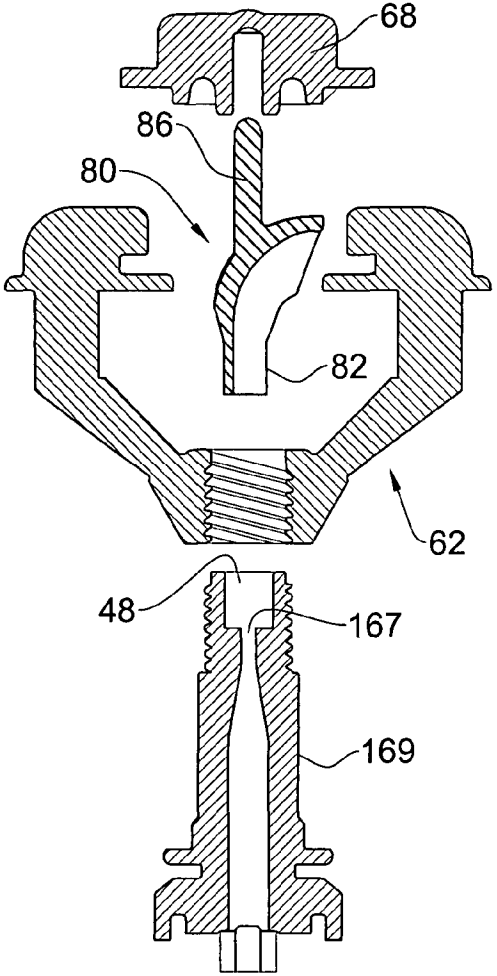

A second embodiment is illustrated in FIG. 4B, where stem member 169 is fitted with a threaded outlet end 170 for coupling thereto a bridge member 171 formed (integrally or fixedly attached thereto) with a nozzle 172 of specific nominal flow rate. The irrigation head 173 is formed with an axial projection 174 rotatable within a receptacle 175 of the bridge member 171, and further with an axial boss 176 rotatably supported by a locking piece 177 fastened to the bridge member 171.

According to the embodiment of FIG. 4B, it is apparent that the bridge member/cover generally designated 171 has in fact several different functions, namely:

- Sealing/closing the shielding portion of the housing;
- Serving as a bridge for supporting the irrigation head at an end thereof separate from the outlet nozzle (in several different configurations, as discussed above);
- Comprising the outlet nozzle;
- Rotatably supporting the irrigation head; and
- Sealing/closing draining ports of the housing at the first (retracted) position to prevent insect and dirt ingress, whilst opening the drain ports at an irrigating position.

The irrigation head, as seen in the various embodiments of the present invention, is formed as part of the bridge member (integral therewith, or assembled thereto). Further, the irrigation head substantially does not axially displace with respect to the stem member and the bridge member, thereby retaining stability and bearing features.

It is appreciated that the bridge member may be articulated to the stem member in other versions, e.g. bayonet coupling, snap-type connection, etc. Furthermore, it is this arrangement that makes it possible to provide bridge members each fitted with a nozzle having a different nominal flow rate, distinguishable from one another, e.g. by different colors of the bridge member.

A third example is illustrated with reference to FIG. 4C where like elements are identified by same reference numbers as in FIG. 4B with a prime (') indication. According to this embodiment the stem member 169' is fitted at its outlet end 170' with a nozzle receptacle 187' for securely receiving a replaceable outlet nozzle 189'. Bridge member 171' is screw coupled over the stem 169' and retains the replaceable outlet nozzle 189' in place. Bridge member 171' is formed with a receptacle 191' rotatably receiving the irrigation head 173', the later comprising an inlet portion 174' rotatably received within receptacle 191', and at its opposite end there is formed a boss 176' rotatably received within a corresponding receptacle of a locking piece 177' fastened to the bridge member 171'. According to one other modification (not shown), the irrigation head 173' may be rotatably supported within a suitable cavity formed at the end of outlet nozzle 189', when the later is received within the stem member 169'.

It is preferable, however, that the flow rate of the outlet nozzles should correspond with the nominal performance of the flow control assembly and accordingly, it would be advantageous that there be provided indication means for such correspondence, e.g. matching colors or colored portions of the bridge member and the housing, dedicated connections e.g. bayonet connections suitable for only one type of outlet nozzles, etc.

Figure 5A:
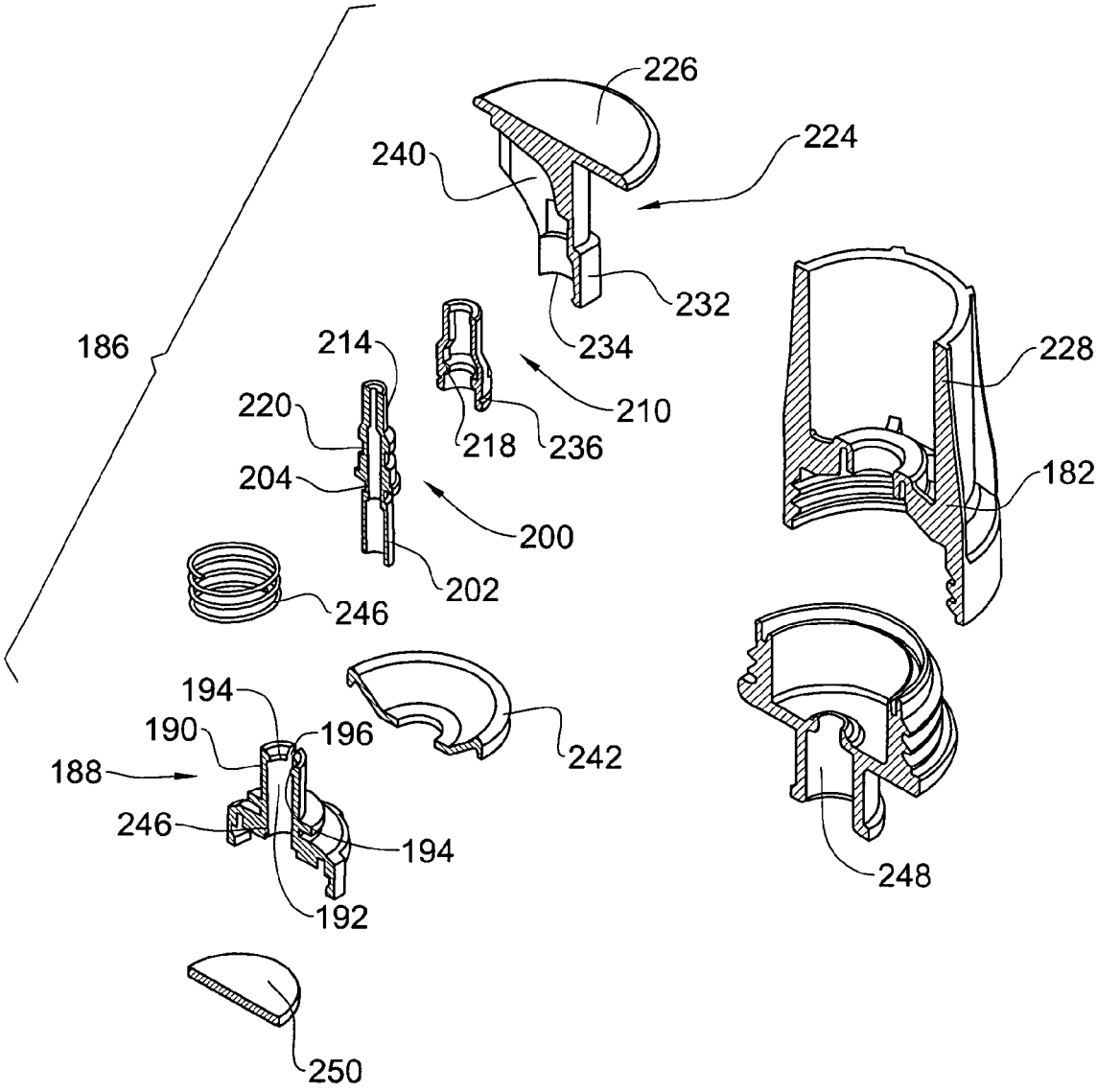
Figure 5B:
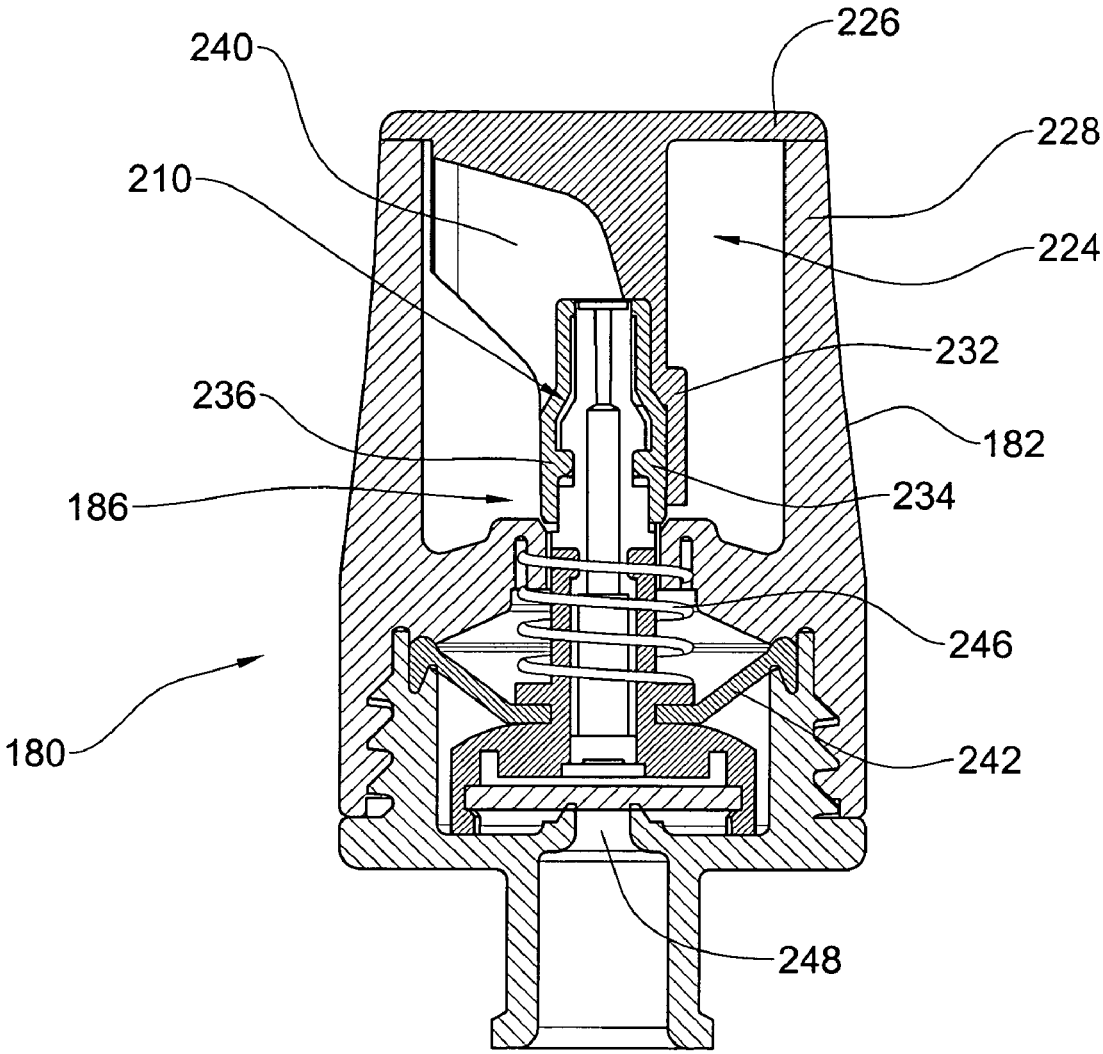
Figure 5C:
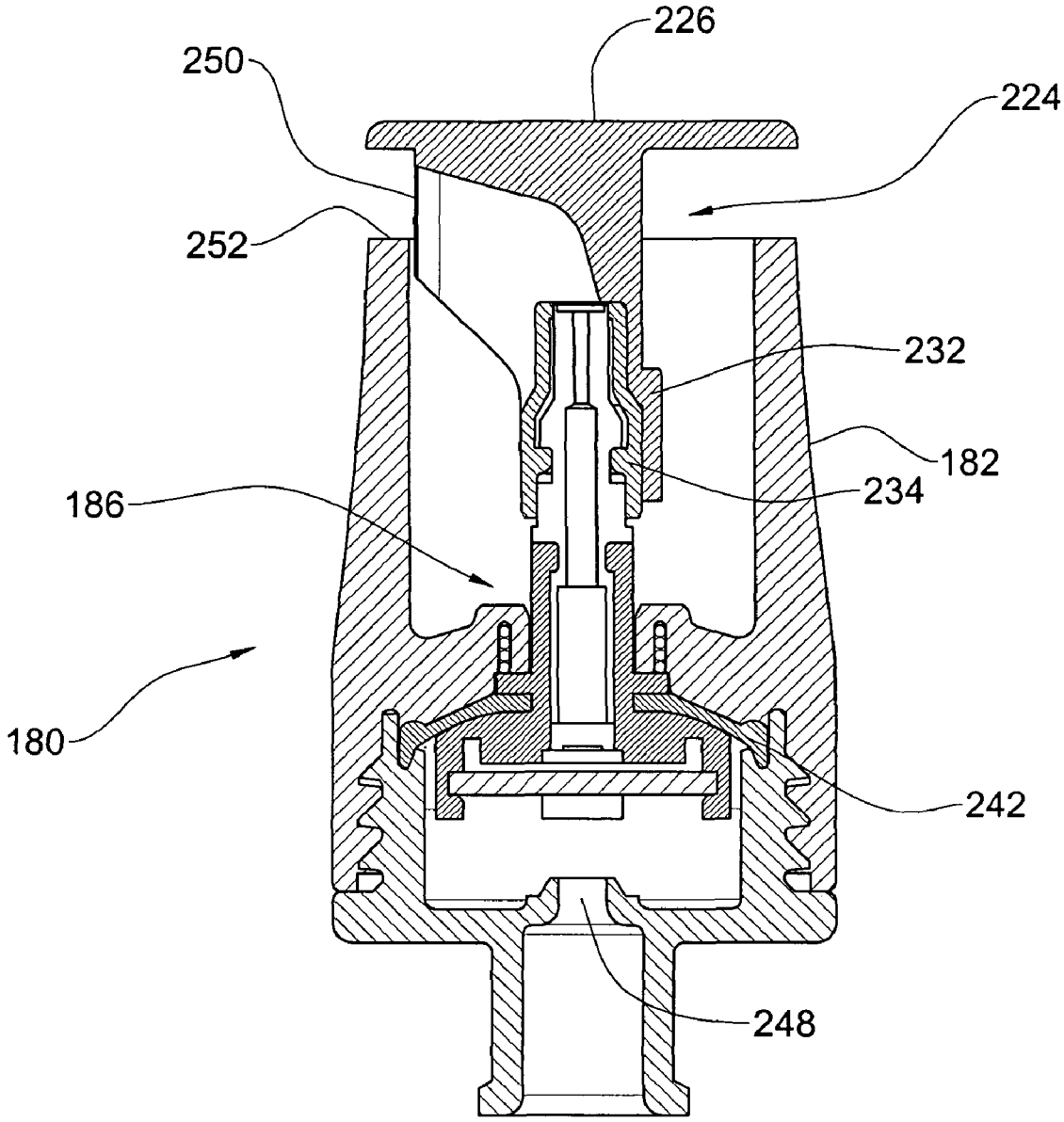

Further attention is now directed to FIGS. 5A to 5C of the drawings directed to a different embodiment of the present invention, in this case concerned with a bridge-less sprinkler generally designated 180. Apart from the housing 182 being somewhat different in its general appearance, the sprinkler has practically the same components as of the previous embodiments and the main difference resides in the structure of the stem member and the irrigation head collectively are referred to at 186 comprising a stem member 188 which has an inlet and similar to that disclosed in connection with the embodiment of FIG. 1 and a shorter stem portion 190 fitted at its outlet end 192 with several inwardly projecting bulges 194 separated from one another by axial slots 196 imparting the structure some resilience.

An extension stem member 200 has a cylindrical portion 202 receivable within the outlet end 192 of stem member 88 and formed with an annular groove 204 snapingly engagable by projections 194 of the stem member 188.

Rotatably mounted on the extension stem member 200 there is a swivel 210, in the form of a rotary bushing, freely rotatable about a cylindrical outlet end 214 of the extension stem member and snapingly retained thereto by means of an inward radial projection 218 snapingly retained by a corresponding annular recess 220 formed on the extension stem member 200.

A reactionary rotatable sprinkler head 224 is formed with a disc-like cover 226 fitted for closing the shielding portion 228 of the housing 182 at the retracted position of the sprinkler (first beveled position) as seen in FIG. 5B, and further it comprises an engagement portion 232 fitted with an annular radial projection 234 snapingly engagable over an annular groove 236 of the swivel 210. The sprinkler head 224 is further formed with a reactionary water flow path 240 giving rise to generating rotary motion upon water flow through that surface.

At the retracted position (FIG. 5B) the beveled diaphragm seal 242 is in its first beveled position under biasing influence of coiled spring 246 in where the inlet port 248 is sealed by flexible diaphragm 250 of the flow control assembly, as explained in connection with the previous embodiment. However, upon introducing water pressure through the inlet port 248, the beveled diaphragm seal 242 toggles into its second beveled position, as in FIG. 5C, resulting in corresponding axial displacement of the irrigation head assembly 246 into the position of FIG. 5C such that water emitted from the reactionary rotatable sprinkler head 224 can easily flow in the gap 250 between an edge 252 of housing 182 and the closing portion 226 of the sprinkler head 224.

The outlet end 214 and the sprinkler head 224 are axially fixed with respect to one another and may also be integrated with respect to one another.

Figure 6A:
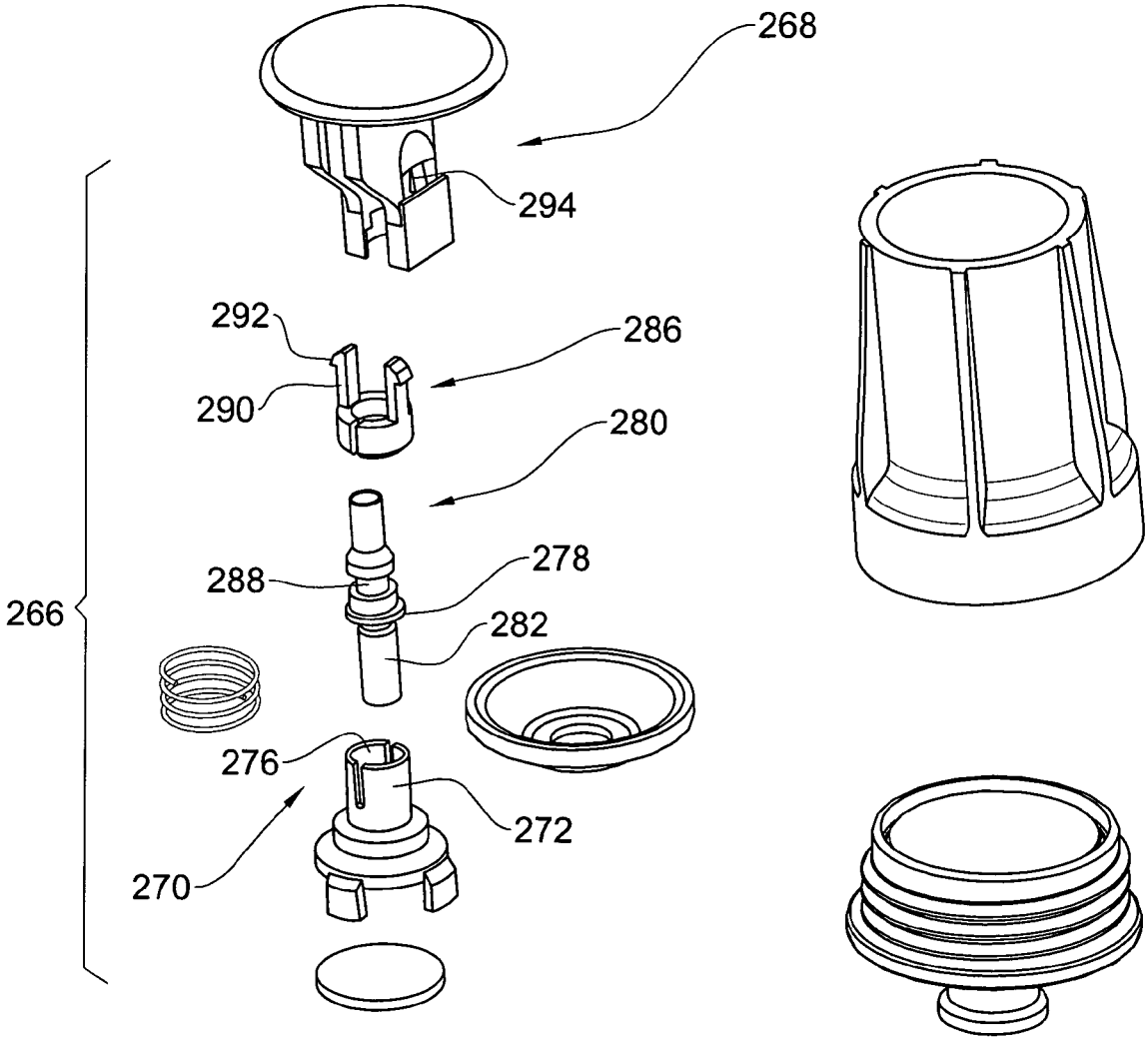
Figure 6B:
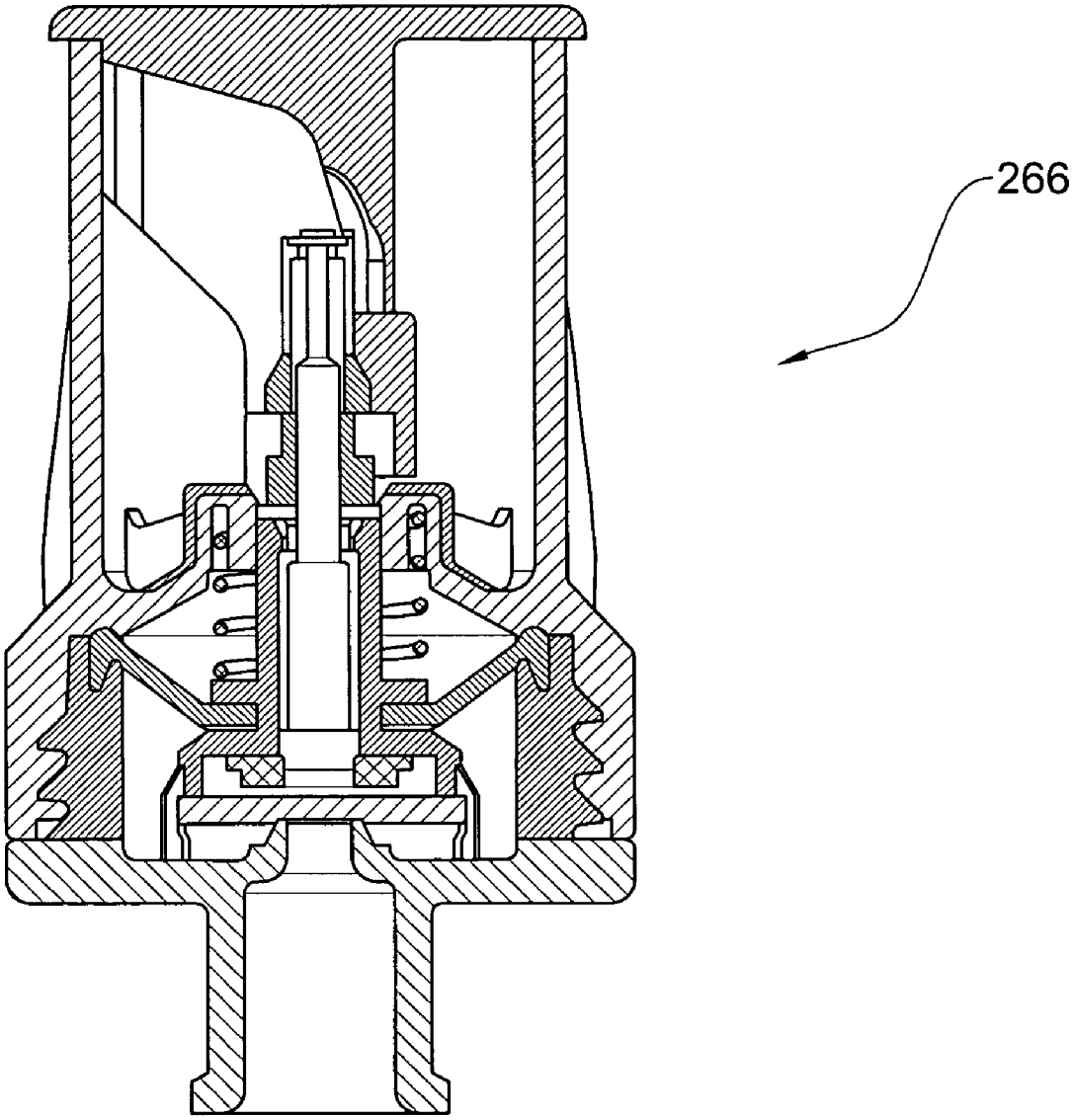
Figure 6C:
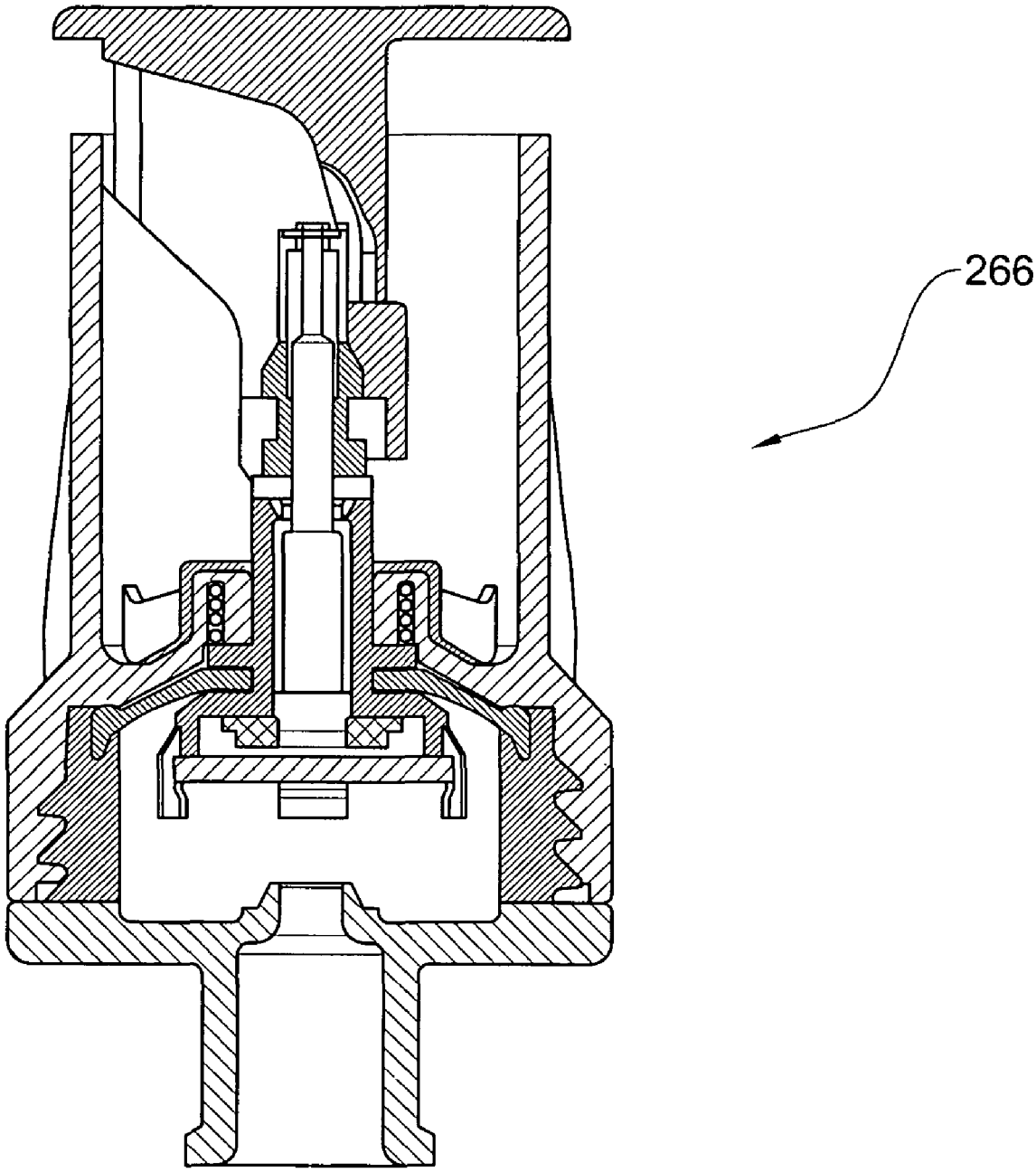

The embodiment of FIGS. 6A to 6C is also directed to a bridgeless sprinkler generally designated 266 and which is significantly similar to the embodiment of FIGS. 5A-5C with the exception of the irrigation head assembly 267 directed to a different embodiment of articulating the reactionary rotatable sprinkler head 268 to the stem member 270. Accordingly, the reader is referred to the detailed description of the previous embodiments describing in detail the other components of the sprinkler. FIG. 6A is an exploded view of the sprinkler 266 and FIGS. 6B and 6C are longitudinal sections of the sprinkler in a closed and an open position, respectively.

The stem member 270 has a short outlet stem portion 272 fitted adjacent its outlet end with inwardly projecting radial snap segments 276 for snap engagement within an annular groove 278 of an extension stem member 280 having a cylindrical portion 282 received within the outlet stem portion 272. Snapingly mounted on an opposite end of the extension stem member 280 there is fitted a swivel 286 snapingly engagable about an annular groove 288 of the extension stem member 280.

The swivel 286 is fitted with two axial projecting legs 290 each formed at its free end with a laterally projecting lug 292 suited for snapingly engagement within corresponding apertures 294 formed in a reactionary rotatable sprinkler head 268.

The arrangement is such that once the reactionary rotatable sprinkler head 268 is mounted on the swivel 286 it prevents the swivel from unintended disengagement from the extension stem member 280 in that it embraces the legs 290 though allowing sufficient freedom for the swivel to rotate about the extension stem member.

It is noticed that the sprinkler head 268 has two rotational degrees of freedom, i.e. one imparted by the swivel 286 freely rotatable about the extension stem member 280 and the other imparted by extension stem member 280 rotatable within the stem member 270. It is further noticed that the snapping portions are typically non continuous thus being formed with grooves so as to dispose of dirt, sand grains, weeds, algae, etc.

A person versed in the art will appreciate that other aspects which have already been disclosed in connection with the first embodiment disclosed in FIGS. 1 and 2 may just as well be applied also in the embodiments of FIGS. 2 and 6 e.g. the flow control assembly, liquid preventing device (LPD), flow rectifier, stem support arrangement, etc.

It is further noticed, although not mentioned in connection with the embodiments of FIGS. 5 and 6, that the beveled diaphragm disc, in its second beveled position (FIGS. 5C and 6C, respectively) bear against corresponding support surfaces of the housing such that the beveled diaphragm seal is not tensed in this position.

Furthermore, whilst not illustrated, it is appreciated that the sprinklers in accordance with the embodiments of FIGS. 5 and 6 may also be provided with draining ports which may or may not be sealed in the retracted position.

Figure 7A:
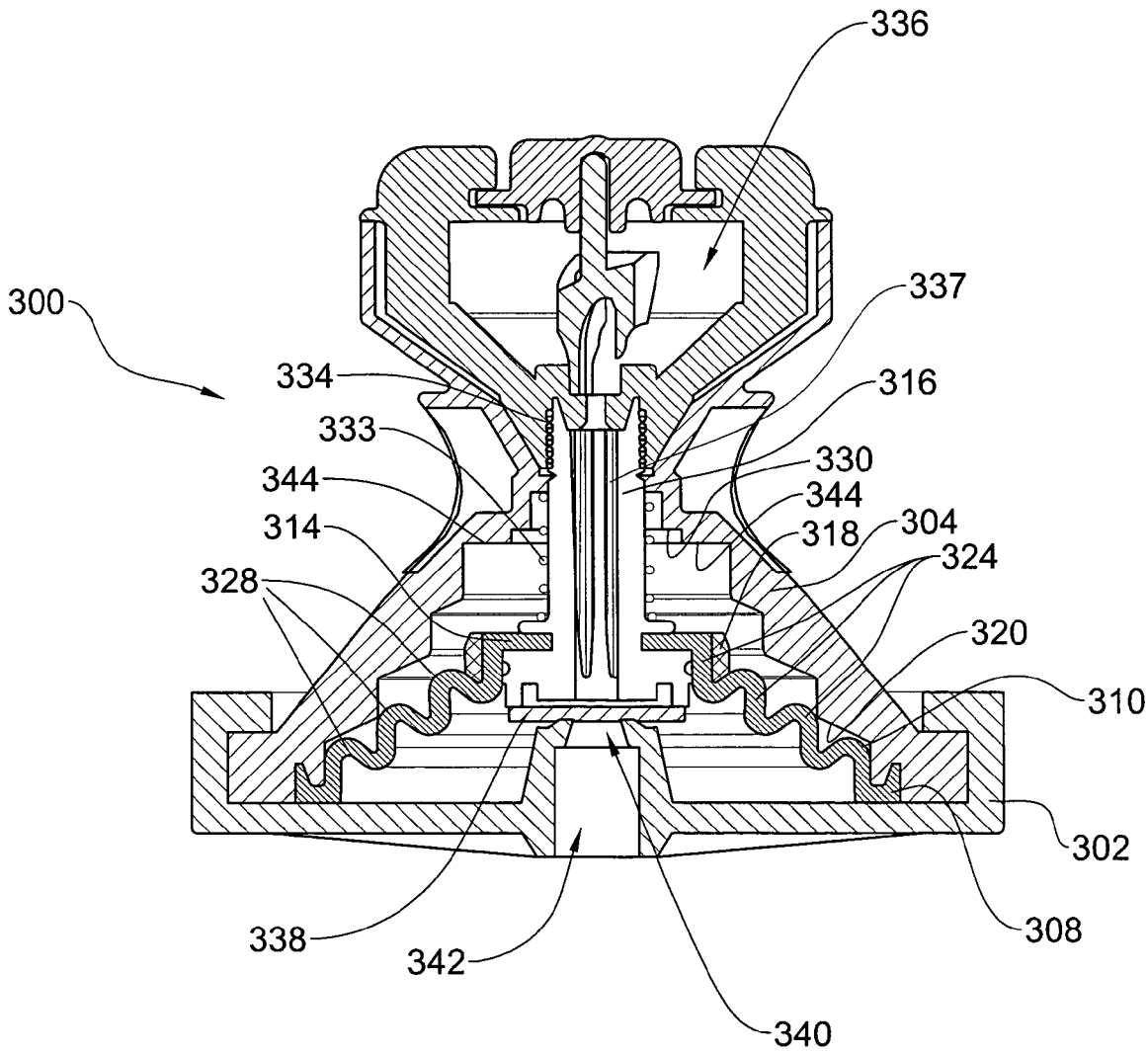
Figure 7B:
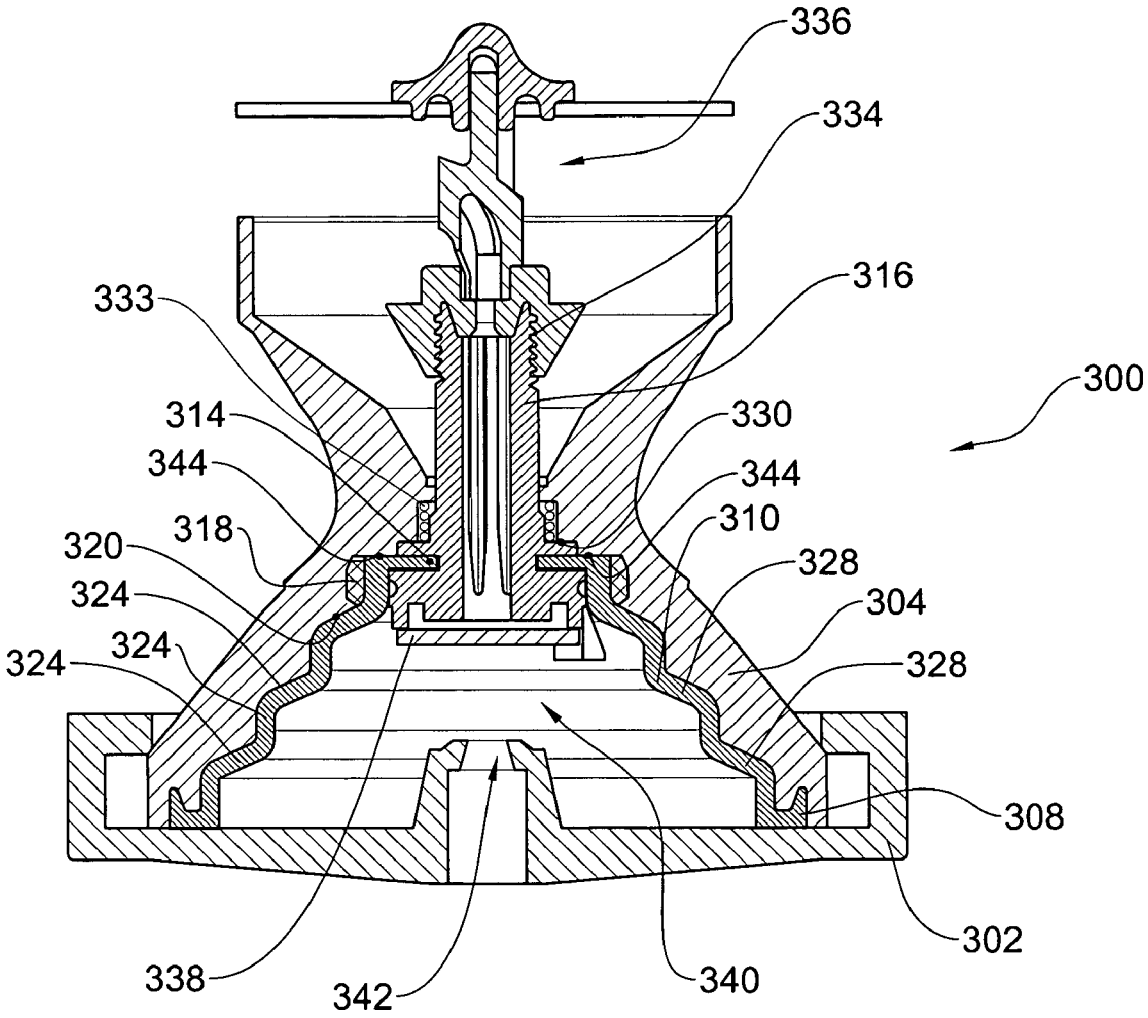

Further attention is now directed to the embodiment of FIGS. 7A and 7B, illustrating a rotary sprinkler 300, where the housing comprises a base member 302 screw coupled to a body portion 304 of the housing, clampingly securing a first rimmed edge 308 of a ziggurat-like diaphragm seal 310, where a second rimmed edge 314 thereof is securely retained to a stem member 316 by a fastener 318. The body portion 304 of the housing comprises an inner surface 320 corresponding in shape and dimensions with that of the diaphragm seal 310, to thereby support it at the extracted/operative position (FIG. 7B), thereby substantially eliminating tension force within the diaphragm seal 310 as already explained herein before.

It is further noted that the diaphragm seal 310 in its first position (FIG. 7A) resembles a bellows, which upon deformation to its second position (FIG. 7B) substantially does not undergo elastic deformation. It is seen that the diaphragm seal comprises first portions 324 (substantially vertically extending in both positions), and second, inclined portions 328 where deformation between positions is particularly by change of inclination of the inclined portions 328, however without tensioning thereof.

Stem member 316 is supported within the housing 304 and is restricted to axial displacement only, by means of annular support 330 (which as already mentioned hereinabove may be in the form of radial fins, sectorial segments, etc). Furthermore, there is a coiled spring 333 biasing stem member 316 and the associated irrigation head 336 into the retracted/closed position (FIG. 7A). In this position seal 338 of the flow control assembly 340 sealingly engages the inlet port 342 formed at the base member 302 of the housing, thus serving as a leak preventing device (LPD). Also noted, the housing 304 is formed with an axial displacement restricting portion 344 in the form of an annular shoulder, which restricts axial displacement of the stem 316 and thus of the diaphragm seal 310, to thereby substantially prevent tensioning thereof in the second, operative position (FIG. 7B).

Figure 8A:
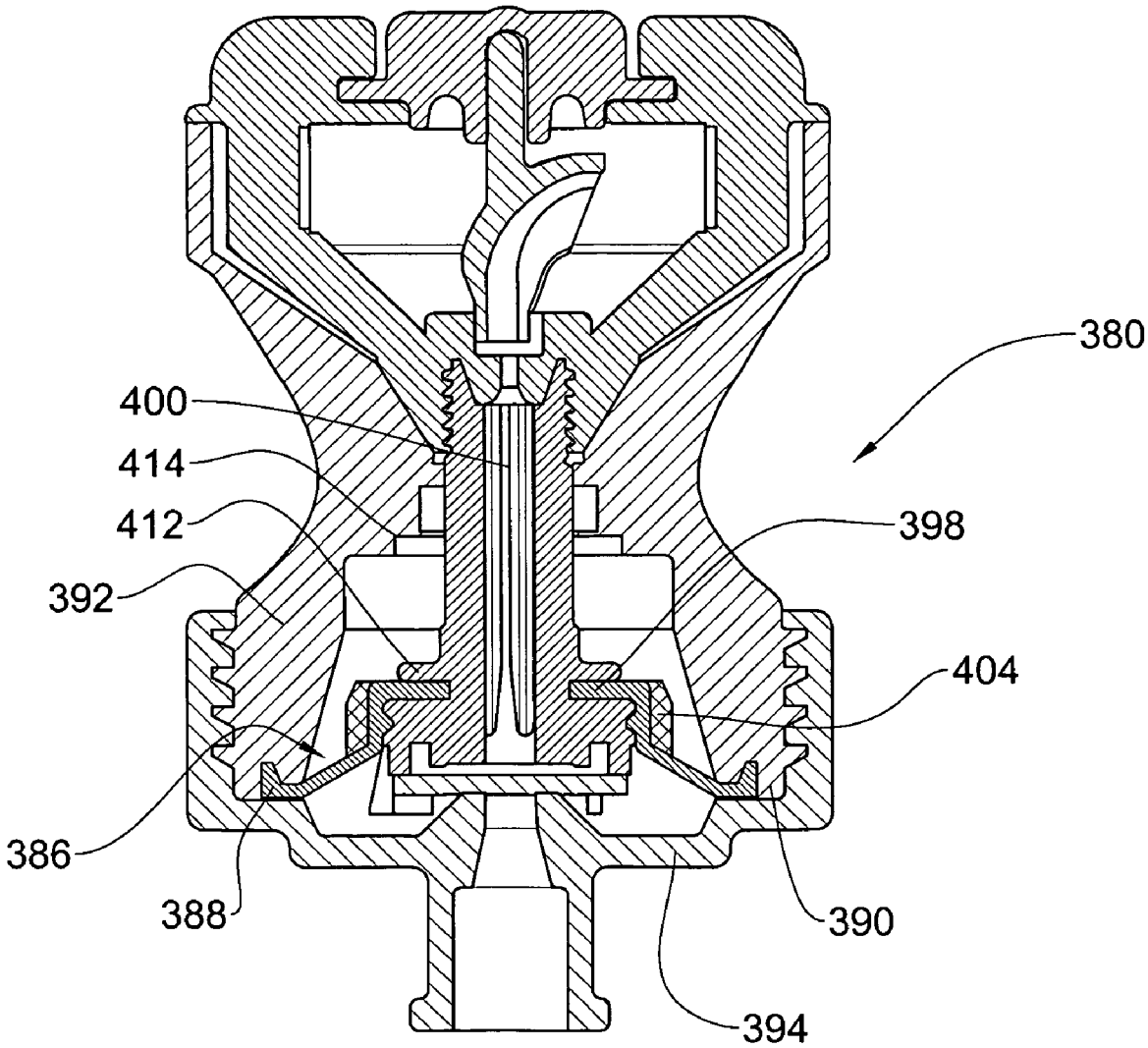
Figure 8B:
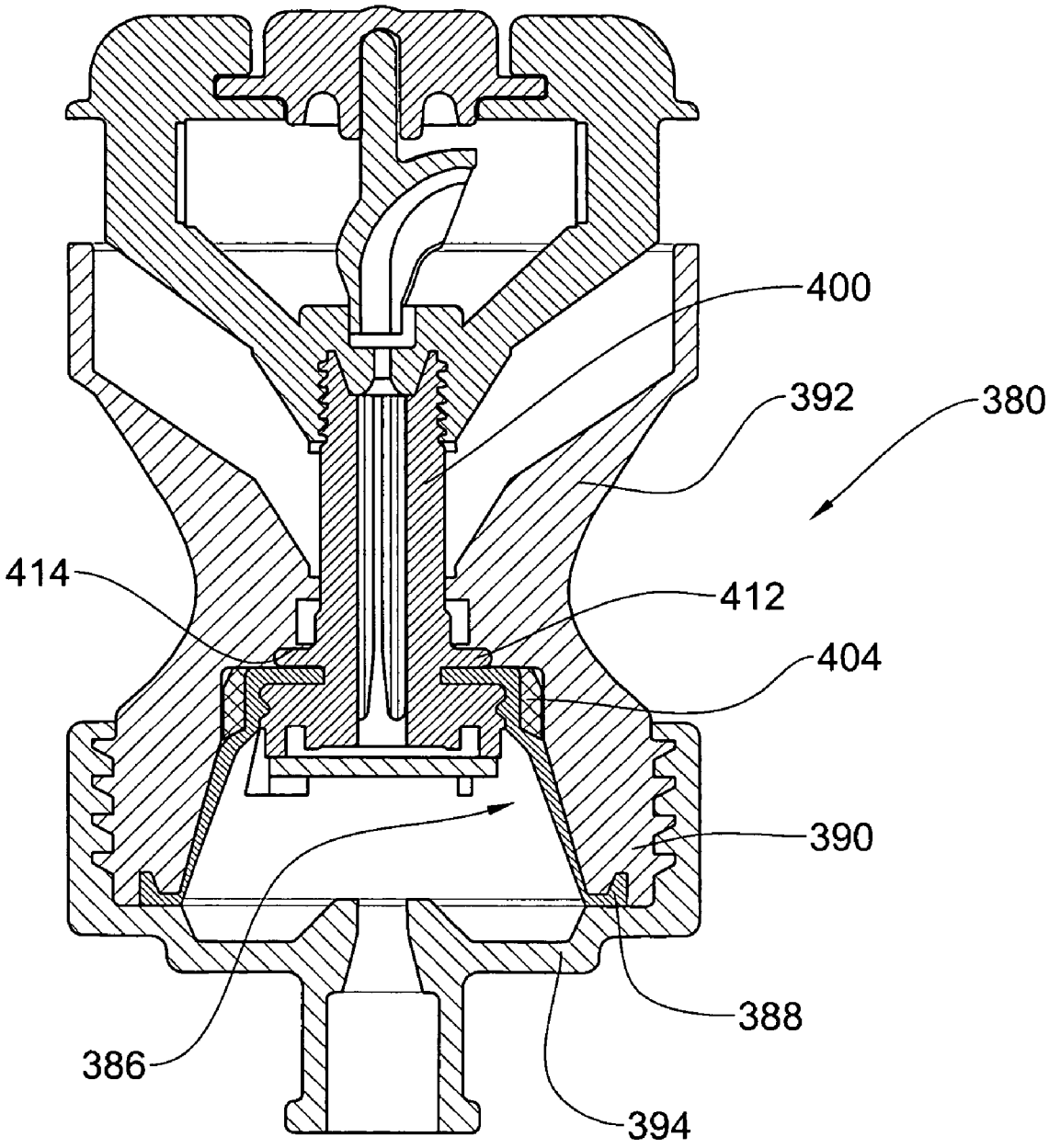

Another application of the invention is illustrated in FIGS. 8A and 8B of the drawings directed to a rotary sprinkler 380, being similar to the construction of the sprinkler 300 of FIGS. 7A and 7B, apart from the diaphragm seal 386.

In the present embodiment the diaphragm seal 386 is clamped at a first rimed portion 388 between a seat 390 of the housing 392 and a screw coupled base member 294. A rimmed portion 398 at an opposite end of the diaphragm seal 386 is secured to the stem member 400 and retained by a retention ring 404.

Other components of the sprinkler 380 are similar as those described in connection with sprinkler 300 of FIGS. 7A and 7B, however with the exception that the diaphragm seal 386, in its first position, namely the retracted position of FIG. 8A, is pre-tensed to thereby apply a biasing force to retract the stem member 400 and the components articulated thereto, whilst at the second position, namely the operative position as in FIG. 8B, the diaphragm seal 386 is tensed and deformed under water pressure to facilitate displacement of the stem into the second position. This arrangement obviates the need to provide a biasing spring as in some of the previous embodiments, for retracting the sprinkler into the retracted, first position.

In the position of FIG. 8B an annular shoulder 412 of the stem member 400 bears against a corresponding stopper shoulder 414 of the housing 392, to thereby restrict its axial displacement.

Whilst in the position of FIG. 8B the diaphragm seal 386 does not bear against the corresponding wall portion of the housing, this can easily be achieved by forming a suitable indention for accommodating the retention ring 404.

Part for the above differences, operation of the sprinklers 300 and 380 illustrated in FIGS. 7A; 7B and 8A; 8B, respectively, is similar to that disclosed in connection with the previous embodiments and reference is made to the relevant passages of the specification. Other components and structural features of the sprinkler, may be similar to those already disclosed hereinabove, e.g. flow/pressure control assembly, drain ports, type of irrigation head (i.e. static, rotational, bridge or bridgeless, dampened, etc), mounting, flow straitening fins (337 in FIG. 7A) etc.

Turning attention now to FIGS. 9A-9F, there is illustrated a further embodiment of a sprinkler according to the present invention, generally designated 500, which comprises components similar to those described in previous embodiments, with the exception of added guard portions. The guard portions are designed to provide the sprinkler 500 protection from dirt and insects, etc., from entering therein, when the sprinkler 500 is in its open/operative position.

Figure 9A:
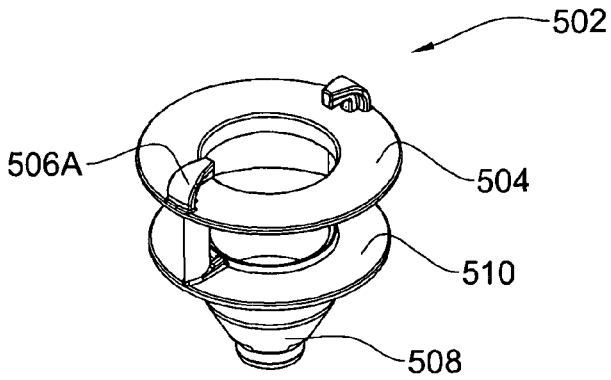

In FIG. 9A, an alternative bridge member, generally designated 502, is illustrated. Similar to previously described bridge members, this bridge member 502 comprises a top cover portion 504, arresting ribs 506A, and a sealing portion 508. The bridge member 502 is formed with an integral annular guard portion 510, extending intermediate the sealing portion 508 and the top cover portion 504, for preventing insects and undesirable material from entering the sprinkler housing during the open/operative position thereof (FIGS. 9D and 9F).

Figure 9B:
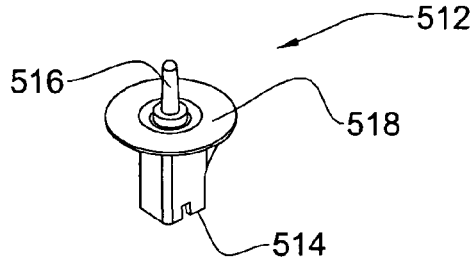
Figure 9C:
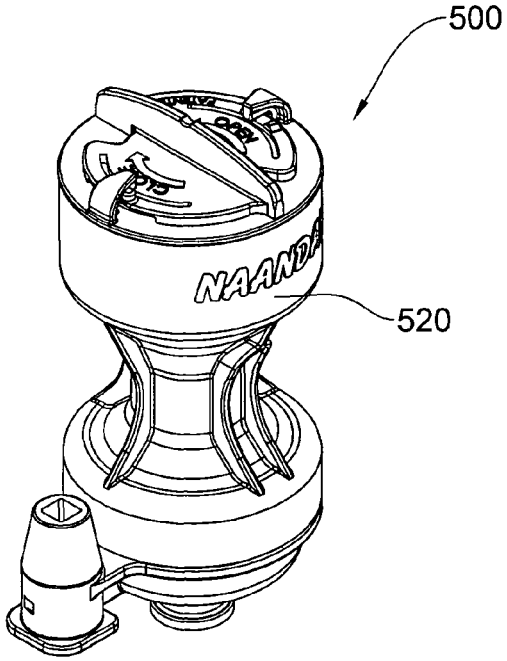

In FIG. 9B, an alternative reactionary rotatable irrigation head, generally designated 512 is illustrated. Similar to previously described irrigation heads, it comprises an inlet portion 514, and an axially projecting boss 516. Between the inlet portion 514 and an axially projecting boss 516, there is an annular guard portion 518 integrally formed therewith for preventing insects and undesirable material from entering the sprinkler housing during the closed position thereof, as in FIG. 9E.

Figure 9D:
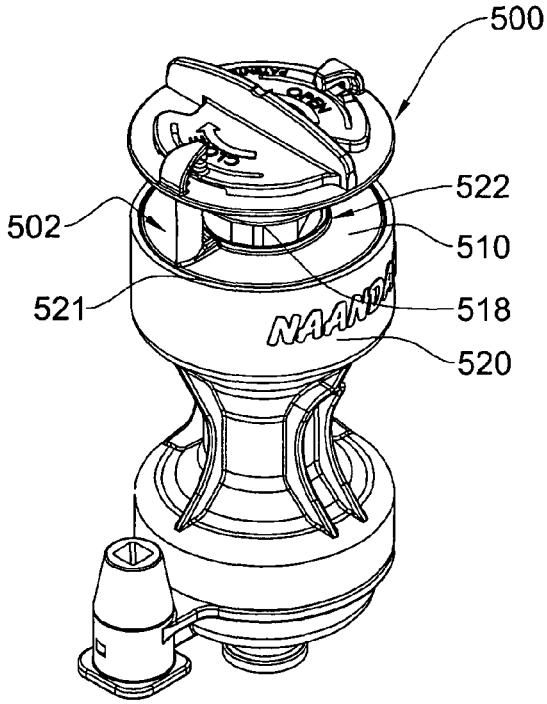
Figure 9F:
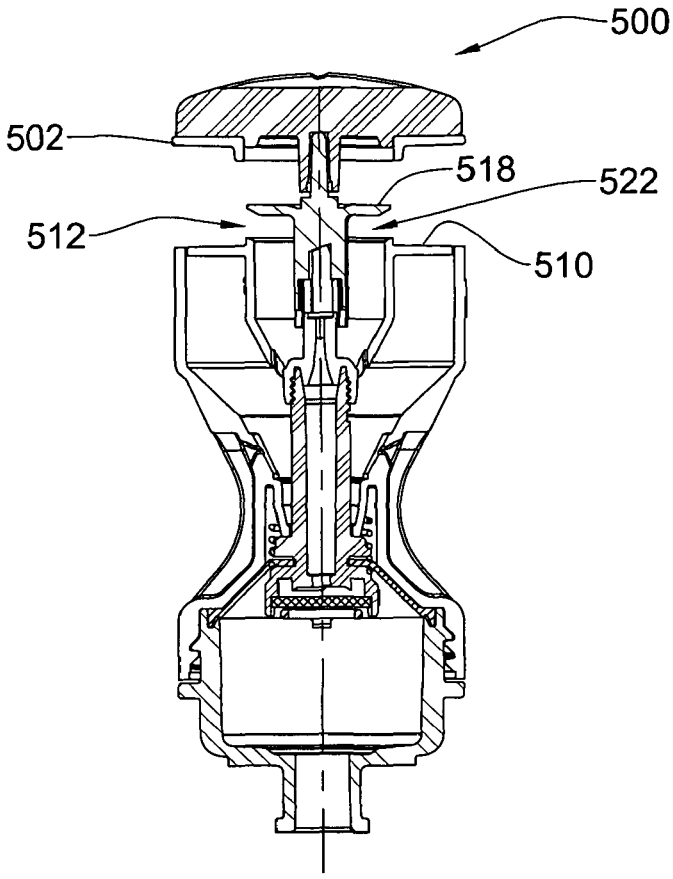
Figure 9E:
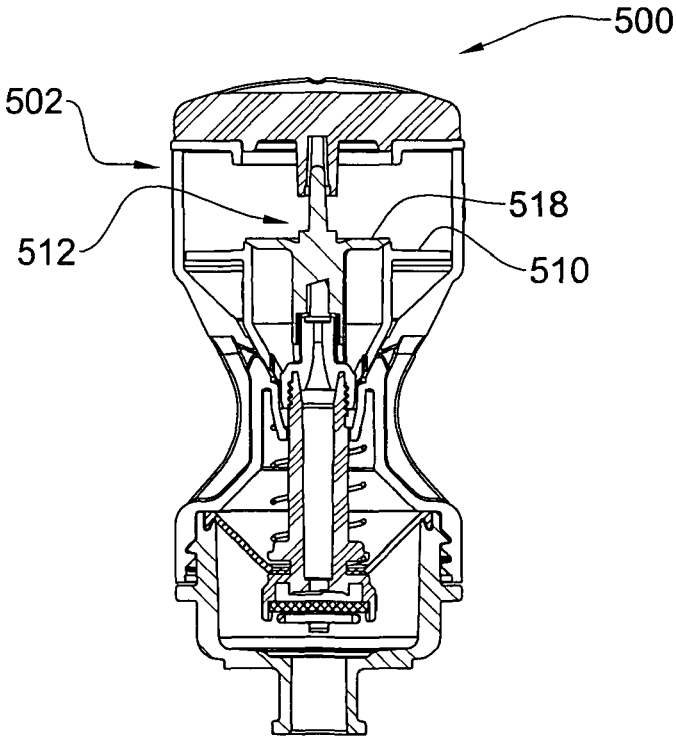

Referring now to FIGS. 9C-9F, the sprinkler 500, is illustrated in open/operative position and closed/non-operative position. In FIG. 9D the annular guard portion 510 of the bridge member 502 is shown adjacent (substantially flush) to the top edge 521 of the housing 520 of the sprinkler 500, to create an insect and dirt seal-type effect. Notably, in the open/operative position shown in FIGS. 9D and 9F, the guard portion 518 of the irrigation head 512 is spaced from the guard portion 510 of the bridge member 502. This space, designated by the numeral 522, is used by the irrigation head as the outlet from which liquid is sprayed.

Items such as insects and undesirable material are therefore prevented from entering the space 522 during operation of the sprinkler by the spray of liquid therefrom.

It is appreciated that the above descriptions are intended only to serve as examples and that many other embodiments are possible, all of which fall within the spirit and the scope of the present invention. For example, the irrigation head may be static or rotational, there may be provided dampening means, etc. Furthermore, the sprinkler according to the present invention may be fitted for an upright position or an inverted position ('top down'), where suitable suspension means may be provided.

The invention claimed is:

1. A sprinkler comprising: a housing fitted with an inlet port connectable to a water supply line and extending into an inlet chamber, a hollow stem member with an inlet end thereof being in flow communication with said inlet chamber and an outlet end thereof being in flow communication with an irrigation head; a diaphragm seal sealingly fixed at peripheral boundaries thereof to the housing and sealingly articulated to the stem member and supporting the stem member at an essentially upright position, said diaphragm seal being deformable between a first position in which the irrigation head is retracted within the housing and a second position in which the irrigation head projects from and outside the housing, characterized in that said stem member is radially supported to enable only sliding displacement in an axial direction from the inlet chamber towards the irrigation head without any tilt or rotation, wherein the diaphragm is fully contained within the housing in both the first and second positions; and at least one guard portion configured to prevent insects and undesirable material from entering the sprinkler housing during said second position.

2. A sprinkler according to claim 1, wherein the stem member and the irrigation head are axially displaceable within the housing, respective to deformation of the diaphragm seal.

3. A sprinkler according to claim 1, where the diaphragm seal is a beveled annular disc made of an elastic material.

4. A sprinkler according to claim 1, wherein the housing comprises a shielding portion accommodating at least a portion of the stem member and the irrigation head.

5. A sprinkler according to claim 4, further comprising a bridge member articulated to one of the stem member and the irrigation head, whereby the shielding portion is closable by said bridge member at the first position.

6. A sprinkler according to claim 4, wherein the shielding portion is formed with one or more drain ports.

7. A sprinkler according to claim 6, wherein the one or more drain ports are sealed at the first position.

8. A sprinkler according to claim 7, wherein at the first position a portion of the stem or of the articulated bridge member displaces into sealing engagement with the one or more drain ports.

9. A sprinkler according to claim 5, being a rotary sprinkler fitted with a reactionary rotatable irrigation head.

10. A sprinkler according to claim 9, wherein the irrigation head is formed with an axial boss rotatably received within a corresponding bushing receptacle formed at a top of the bridge member, articulated to the stem member.

11. A sprinkler according to claim 1, wherein the inlet chamber is fitted with a flow control assembly.

12. A sprinkler according to claim 11, wherein the flow control assembly comprises a flexible membrane retained within the inlet chamber which responsive to pressure differential thereover is deformable to constrict the cross section area of a liquid flow path into the inlet end of the stem member.

13. A sprinkler according to claim 11, wherein the flow control assembly is axially displaceable along with the stem member.

14. A sprinkler according to claim 12, wherein at the first position the flexible membrane bears against the inlet port, thus serving as a leak preventing device, ensuring the inlet port is sealed until water pressure at the inlet port reaches a minimal nominal pressure.

15. A sprinkler according to claim 1, fitted with a differential pressure control assembly comprising a differential pressure membrane received within the inlet chamber and supported adjacent the inlet end of the stem member, wherein said membrane deforms responsive to pressure differential between an inlet face thereof and an outlet face thereof to thereby vary a through-flow path into said inlet end of the stem.

16. A sprinkler according to claim 1, wherein the diaphragm seal divides the housing into a pressurized zone at a side thereof facing the inlet port, and an essentially atmospheric pressure zone at its other side.

17. A sprinkler according to claim 1, wherein the housing is suitable for suspending at an inverted position with the inlet port up and the irrigation head down.

18. A sprinkler according to claim 1, wherein the diaphragm seal is biased into its first position.

19. A sprinkler according to claim 1, wherein the diaphragm seal is biased by a coiled spring bearing at a first end against a portion of the housing and at a second end against a portion of the stem member.

20. A sprinkler according to claim 1, wherein at its second position the diaphragm seal bears against a corresponding supporting surface of the housing.

21. A sprinkler according to claim 1, wherein the diaphragm seal is sealingly retained over an annular groove of the stem member.

22. A sprinkler according to claim 1, the diaphragm seal is articulated to the stem member with possibility for eliminating radial and axial tolerance.

23. A sprinkler according to claim 1, wherein the diaphragm seal is substantially un-tensed at either of its two respective positions.

24. A sprinkler according to claim 1, wherein the diaphragm seal is beveled.

25. A sprinkler according to claim 24, wherein the beveled diaphragm seal toggles into its respective first and second positions.

26. A sprinkler according to claim 24, wherein the beveled diaphragm seal comprises an outer peripheral portion for clamp engagement to the housing, an inner peripheral portion for annularly arresting the stem member, and a beveled portion intermediate said peripheral portions.

27. A sprinkler according to claim 1, wherein axial displacement of the stem member is restricted by a shoulder of the stem member engageable with a corresponding bearing surface of the housing.

28. A sprinkler according to claim 1, wherein the stem member is supported within the housing in a fashion allowing only axial displacement thereof.

29. A sprinkler according to claim 1, wherein the housing is formed with a neck portion for radial support of the stem member to ensure only axial displacement of the stem member.

30. A sprinkler according to claim 1, comprising a cover member serving for two or more of the functions comprising closing a shielding portion of the housing, serving as a bridge for supporting the irrigation head at an end thereof remote from an outlet nozzle, receiving the outlet nozzle, rotatably supporting the irrigation head, and closing draining ports of the housing at the first position.

31. A sprinkler according to claim 1, comprising a cover member supporting the irrigation head and fitted for closing the housing at the first position.

32. A sprinkler according to claim 1, wherein the irrigation head substantially retains its axial position with respect to the stem member, at the two respective positions.

33. A sprinkler according to claim 1, fitted for an upright or an inverted position.

34. A sprinkler according to claim 32, wherein a support is provided for suspension of the sprinkler at an upright position or at inverted position.

35. A sprinkler according to claim 1, further comprising a bridge member having a sealing portion and articulated to one of the stem member and the irrigation head, wherein said at least one guard portion is an annular guard portion integrally formed with the sealing portion.

36. A sprinkler according to claim 1, wherein at least one guard portion is an annular guard portion integrally formed with the irrigation head.

37. A sprinkler according to claim 1, further comprising a bridge member having a sealing portion and articulated to one of the stem member and the irrigation head, and an annular guard portion integrally formed with the sealing portion and/or said irrigation head; the guard portion being configured to prevent insects and undesirable material from entering the sprinkler housing during said second position.

38. A sprinkler according to claim 37, wherein the guard portion extends intermediate the sealing portion and a top cover portion of the bridge member.

39. A sprinkler according to claim 35, wherein at the second position of the sprinkler the guard portion extends substantially flush with a top edge of the housing.

40. A sprinkler according to claim 37, wherein at the second position of the sprinkler there is a gap formed between the guard portion integrated with the stem member and the guard portion integrated with the irrigation head, for emitting liquid therefrom.

41. The sprinkler according to claim 1, wherein the guard portion extends from the lowest point downstream from the irrigation head, where fluid exits the irrigation head, to the housing.

42. The sprinkler according to claim 1, wherein the guard portion maintains the same shape in the first and second positions.

43. The sprinkler according to claim 1, wherein the guard portion comprises a peripheral edge free of connection to the housing.

44. A sprinkler comprising: a housing fitted with an inlet port extending into an inlet chamber and comprising a beveled diaphragm seal having a first face thereof exposed to pressure within the inlet chamber and a second face exposed to atmospheric pressure; a stem member articulated to said beveled diaphragm seal and having an inlet end thereof extending into the inlet chamber and having an outlet end articulated to an irrigation head, wherein the diaphragm seal is normally retained at a first retracted position where the irrigation head is concealed within the housing, and where water pressure within the inlet chamber deforms the beveled diaphragm seal into a second operative position where the irrigation head axially displaces and projects from and outside the housing, characterized in that said stem member is radially supported to enable only sliding displacement in an axial direction from the inlet chamber towards the irrigation head without any tilt or rotation, wherein the diaphragm is fully contained within the housing in both the first and second positions; and at least one guard portion configured to prevent insects and undesirable material from entering the sprinkler housing during said second position.

45. The sprinkler according to claim 44, wherein the guard portion maintains the same shape in the first and second positions.

46. A sprinkler according to claim 44, wherein the guard portion comprises a peripheral edge free of connection to the housing.

* * * * *